US006252619B1

(12) United States Patent
Ueda et al.

(10) Patent No.: US 6,252,619 B1
(45) Date of Patent: Jun. 26, 2001

(54) IMAGE FORMING APPARATUS HAVING A PRINTHEAD GUIDE MECHANISM

(75) Inventors: Hidenori Ueda; Takashi Wakana, both of Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 09/458,821

(22) Filed: Dec. 13, 1999

(30) Foreign Application Priority Data

Dec. 14, 1998 (JP) ..... 10-354802

(51) Int. Cl.[7] ..... B41J 2/385; G03G 13/04
(52) U.S. Cl. ..... 347/138; 347/152; 399/125
(58) Field of Search ..... 347/138, 152, 347/245, 263; 399/110, 111, 113, 114, 118, 125

(56) References Cited

U.S. PATENT DOCUMENTS 4,905,028 * 2/1990 Okubo et al. ..... 347/138
5,291,249 * 3/1994 Lee ..... 399/113
5,477,306 * 12/1995 Iguchi et al. ..... 347/152 X
5,978,626 * 11/1999 Nagamine et al. ..... 399/125

* cited by examiner

*Primary Examiner*—Sandra Brase
(74) *Attorney, Agent, or Firm*—Rabin & Champagne, P.C.

(57) ABSTRACT

An image-forming apparatus comprises a stationary main body, a lid assembly, an exposing unit, and a guide mechanism. The stationary main body accommodates a print process cartridge therein. The main body has an opening that opens upward of the image-forming apparatus. The lid assembly is rotatably supported on the stationary main body so that the lid assembly is rotatable about an axis to open and close the opening. The exposing unit is mounted to an inner side of the lid assembly and extends parallel to the axis. The exposing assembly moves into mating engagement with the print process cartridge when the lid assembly has completely closed the opening. The guide mechanism guides the exposing unit into mating engagement with the print process cartridge when the lid assembly is rotated to close the stationary main body.

14 Claims, 21 Drawing Sheets

IMAGE FORMING APPARATUS HAVING A PRINTHEAD GUIDE MECHANISM

BACKGROUND OF THE INVENTION

1. Field of the Invention

The present invention relates to an electrophotographic image-forming apparatus, and more particularly to the construction in an image-forming apparatus of a guide mechanism for guiding a printhead with respect to a print process cartridge.

2. Description of the Related Art

FIG. 21 is a perspective view of a conventional electrophotographic image-forming apparatus.

The conventional apparatus includes a rotatable lid 1 and a stationary main body 3. The lid 1 is pivotally mounted to the main body 3 so that the lid 1 can be opened and closed relative to the main body 3. The main body 3 incorporates a print process cartridge 7 having a photoconductive drum, not shown. There is provided an operating panel 3*a* at the front end of the main body 3. Operating buttons and other controls, not shown, are provided on the operating panel 3*a*. Shafts 4 are provided at the rear end portions of opposed side walls of the main body 3 and extend toward each other into bearing holes 2 formed in the end portion of the lid 1. Thus, when the lid 1 is rotated in a direction shown by arrow A, the lid 1 closes the opening of the main body 3. A printhead assembly 6 having a printhead 5 therein is attached to the forward underside of the lid 1. The printhead 5 is loosely held in the printhead assembly 6 so that the printhead 5 is movable to some extent within the printhead assembly 6.

When the lid 1 is rotated in the direction shown by arrow A, the printhead 5 moves along an arcuate path into mating engagement with the print process cartridge 7. The printhead 5 is formed with projections 5*a* at longitudinal end portions thereof. The print process cartridge 7 is formed with recesses, not shown, which receive the projections 5*a*. When the lid 1 closes the main body 3, the projections 5*a* completely fit into the recesses in the print process cartridge 7, so that the printhead 5 is accurately positioned with respect to the photoconductive drum in the print process cartridge 7.

The printhead assembly 6 incorporates a compression spring, not shown. When the printhead 5 is fitted into the print process cartridge 7, the compression spring urges the printhead 5 against the print process cartridge 7, thereby preventing the printhead 5 from rattling. Pressing the printhead 5 against the print process cartridge 7 holds the printhead 5 at an accurate position relative to the photoconductive drum, thereby ensuring good print quality.

The operation of the aforementioned conventional image-forming apparatus will be described.

The compression spring urges printhead 5 outwardly from the printhead assembly 6 such that the printhead 5 is resiliently movable in the printhead assembly 6. When the lid 1 is opened, the printhead 5 abuts part of the printhead assembly 6. When the lid 1 is closed, the printhead 5 first engages the print process cartridge 7 and is pushed back by the print process cartridge into the housing of the printhead assembly 6 against the urging force of the compressed spring, so that the spring is further compressed.

The compression spring is compressed more when the lid 1 is closed than when the lid 1 is opened. Thus, the position of the printhead 5 when the lid 1 is opened differs from that when the lid 1 is completely closed.

Therefore, it is necessary to precisely adjust the position of printhead 5 with respect to the printhead assembly 6 after the projections 5*a* of the printhead 5 are fitted into the recesses formed in the print process cartridge 7.

Thus, the orientation of the printhead 5 must be gradually changed in accordance with the rotation of the lid 1 so that while the lid 1 rotates in the arcuate path, the projections 5*a* are properly received into the recesses in the print process cartridge 7. The housing of the printhead assembly 6 must be shaped, taking into consideration where in the arcuate path of the printhead 5 the print process cartridge 7 receives the printhead 5. Thus, the housing has a complicated shape and must be manufactured with a high level of dimensional accuracy.

If the housing of the printhead assembly 6 is shaped such that the orientation of the printhead 5 gradually changes as the lid 1 rotates, the compression spring may urge the printhead 5 in directions that are different from the orientation of the printhead 5 depending on the rotational position of the lid 1. The printhead 5 may not be smoothly oriented according to the shape of the housing. A similar problem occurs when the compression spring has not enough biasing force.

In an attempt to solve the aforementioned problems, the compression spring maybe other shapes, e.g., a cone-shaped spring, than an ordinary cylindrical coil spring. Further, springs having low spring constants or long springs may be used. However, springs of complicated shapes will be expensive.

SUMMARY OF THE INVENTION

The present invention is made in view of the aforementioned problems of the conventional apparatus.

An object of the invention is to provide an image-forming apparatus capable of printing with stable, reliable print quality.

Another object of the invention is to provide an image-forming apparatus where the housing of the printhead assembly that holds the printhead therein can be of a simple shape and therefore can be manufactured at low cost.

An image-forming apparatus according to the present invention comprises first, second, and third assemblies and a guide mechanism. The first assembly is a stationary main body that accommodates a print process cartridge therein. The main body has an opening that opens upward of the image-forming apparatus. The second assembly is a lid assembly that is rotatably, or pivotally, supported on the first assembly so that the second assembly is rotatable about an axis to open and close the opening. The third assembly is an exposing unit mounted to an inner side of the second assembly and extending parallel to the axis. The third assembly moves into mating engagement with the print process cartridge when the second assembly has completely closed the opening. The guide mechanism guides the third assembly into mating engagement with the print process cartridge when the second assembly is rotated. The guide mechanism may include the member of the holder that define a hole therein, a projection that projects from the third assembly and extends through the hole, and a guide groove into which the projection enters to be guided to the print process cartridge.

The second assembly includes a holder and an urging member. The holder loosely holds the third assembly. The urging member urges the exposing assembly in a direction in which the guide groove extends, against the print process cartridge when the third assembly has moved into mating engagement with the print process cartridge. The holder has a member that defines a hole therein. The guide mechanism includes the member that defines the hole in the holder, a projection that projects from said third assembly parallel to the axis and extends through the hole, and a guide groove formed in said first assembly. The guide groove receives the projection therein such that the projection is slidable in the guide groove.

The print process cartridge has a surface that extends parallel to the groove. The third assembly includes a support attached to an end of the third assembly. The support has a first projection that loosely projects parallel to the axis into the hole and a second projection that projects in a direction perpendicular axis. When the second assembly is rotated about the axis to close the opening, the second projection moves into contact engagement with the surface and then slides on the surface until the third assembly moves into mating engagement with the print process cartridge. The axis is substantially at a midway point of a distance over which the second projection slides on the surface until the third assembly has moved into mating engagement with the print process cartridge.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

The present invention will be described in detail with reference to the accompanying drawings.

First Embodiment

<Construction>

Figure 1:
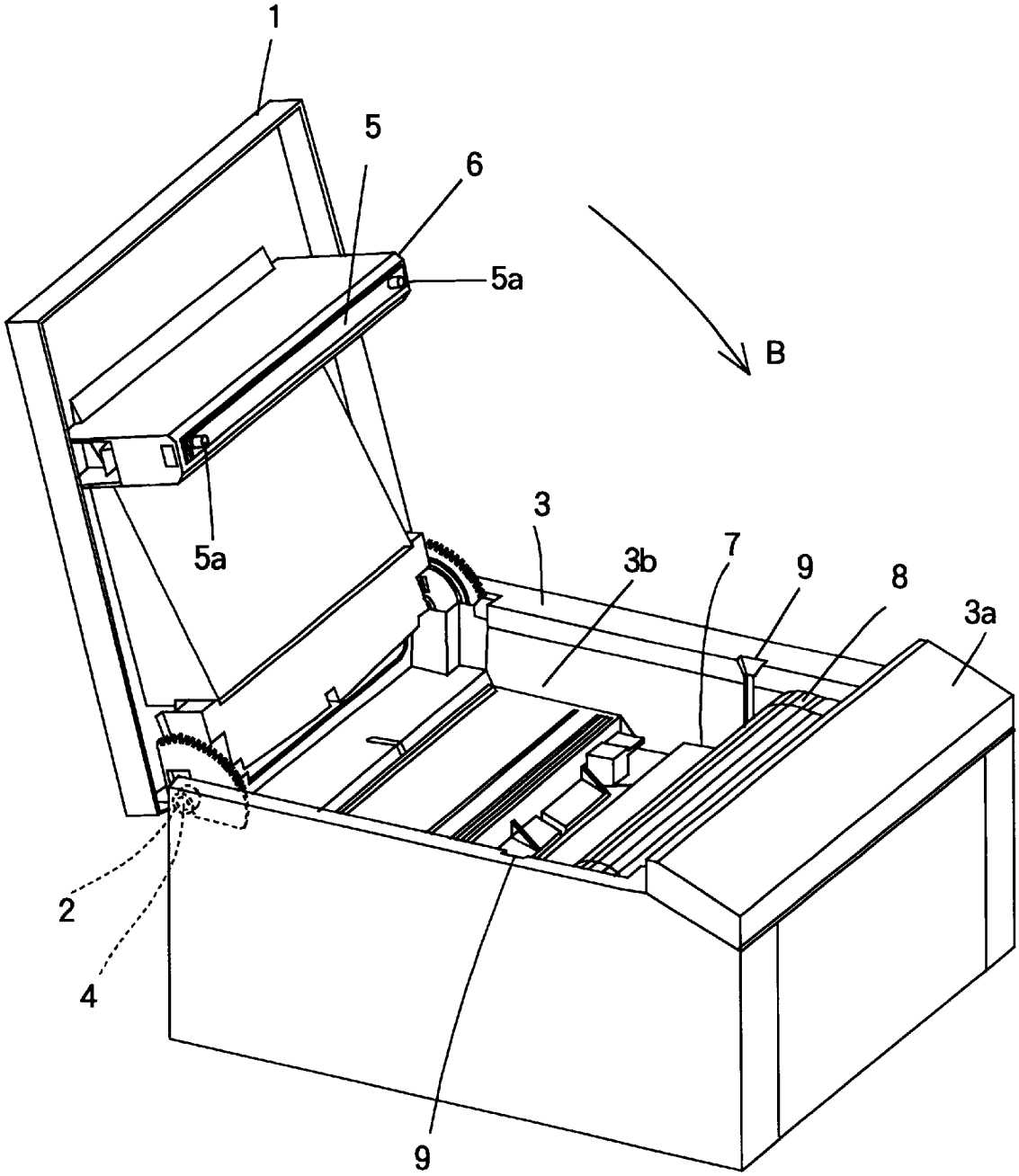
FIG. 1 is an perspective view illustrating an image forming apparatus according to a first embodiment.

FIG. 1 is a perspective view of an image-forming apparatus according to a first embodiment.

Referring to FIG. 1, the apparatus includes a lid 1 and a stationary main body 3 with an opening 3*b*. The lid 1 is rotatably mounted to the main body 3 so that the lid 1 can rotate to open and close the opening 3*b*.

Shafts 4 project inwardly from the rear end portions of opposed side walls of the main body 3 and extend into bearing holes 2 formed in a rear end portion of the lid 1. When the lid 1 is rotated in a direction shown by arrow B, the lid 1 closes the opening 3*b* of the main body 3. A printhead assembly 6 having a printhead 5 is mounted to the forward underside of the lid 1. The printhead 5 is formed with projections 5*a* at longitudinal ends thereof. When the lid 1 is completely closed, the projections 5*a* serve to position the printhead 5 with respect to the print process cartridge 7. The print process cartridge 7 incorporates a toner cartridge 8 under which a photoconductive drum, not shown, is disposed.

Figure 21:
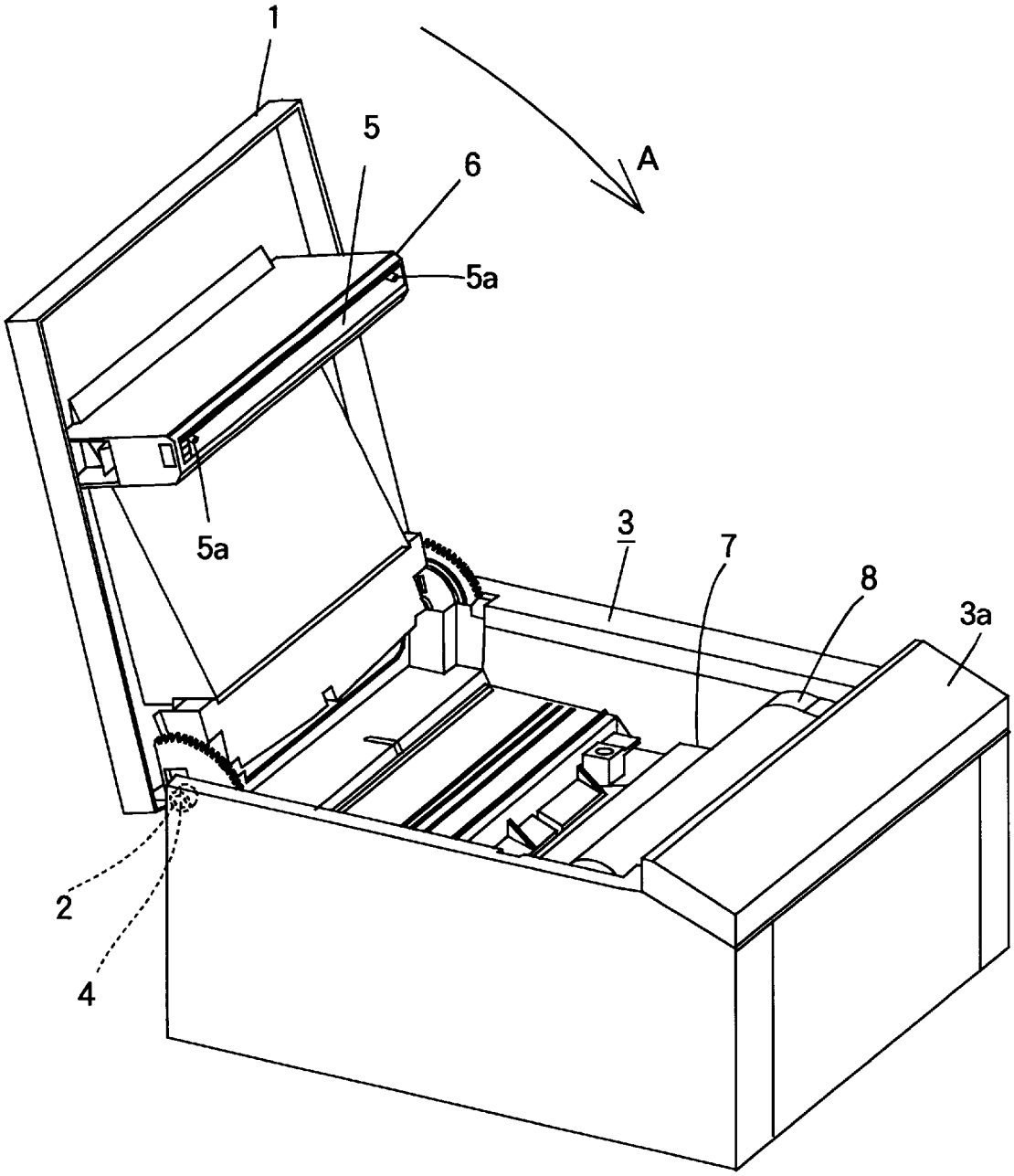
FIG.21 CONVENTIONAL ART
FIG. 21 is a perspective view of a conventional electrophotographic image-forming apparatus.

Each of the opposed side walls of the main body 3 is formed with a guide groove 9 in its inner surface near the print process cartridge 7. The guide grooves 9 oppose each other and extend substantially vertically. The image-forming apparatus according to the first embodiment differs from the conventional image-forming apparatus of FIG. 21 in that the pair of guide grooves 9 are provided in the main body. When the lid 1 is rotated to close the opening 3*b*, the guide grooves 9 guide the printhead 5 toward a predetermined position with respect to the print process cartridge 7.

Figure 2:
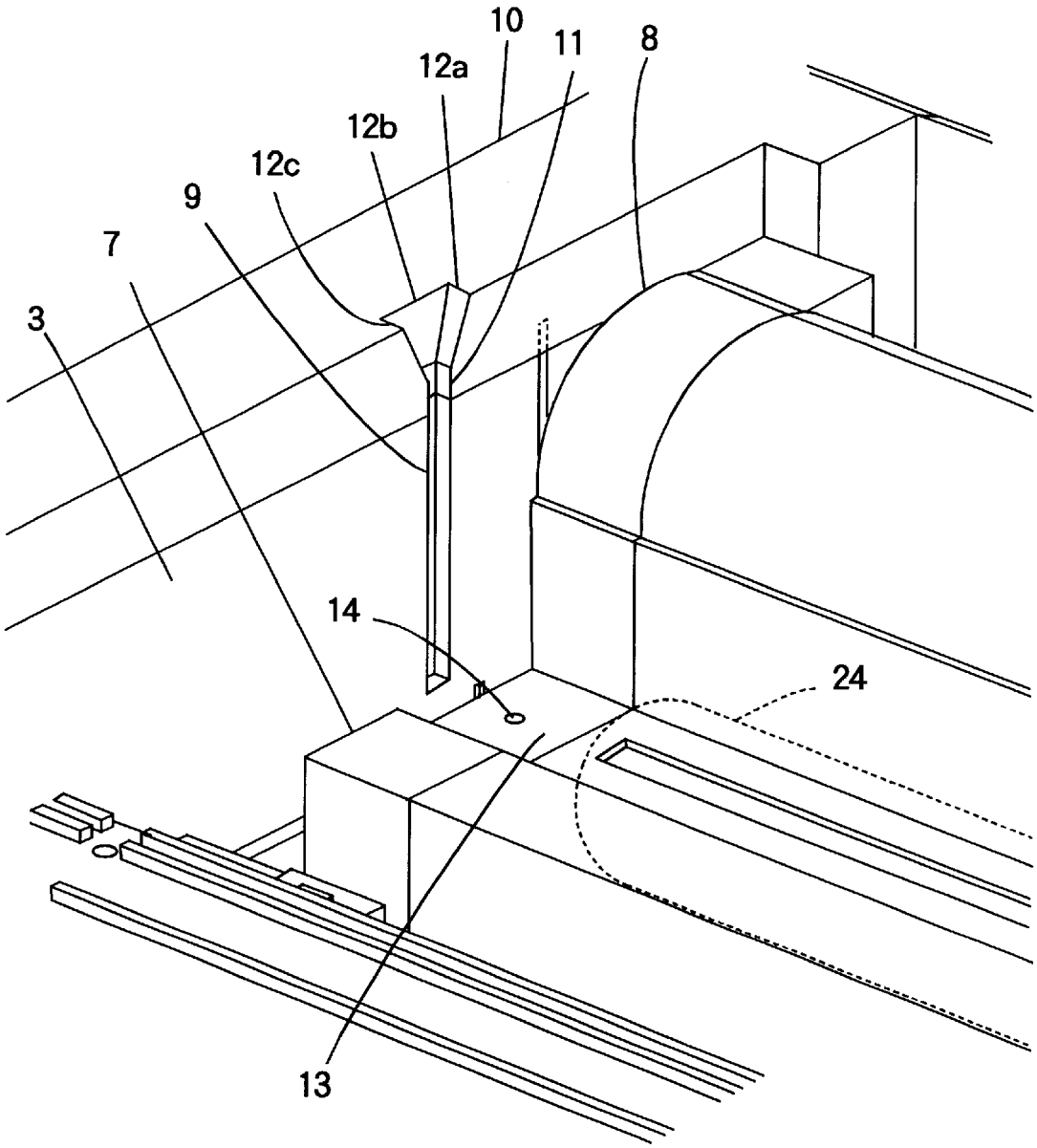
FIG. 2 is a perspective view illustrating an essential part of the first embodiment.

FIG. 2 is a perspective view illustrating an essential part of the first embodiment. As is clear from FIG. 1, the image forming apparatus according to the first embodiment has a symmetric configuration with respect to a vertical plane passing through the main body 3. Therefore, FIG. 2 shows only a left side of the apparatus.

Referring to FIG. 2, the guide 9 extends vertically in the inner surface of the side wall of the main body 3. A lateral member 10 extends on the side wall and decorates the appearance of the main body 3. The lateral member 10 is formed with a guide groove 11 that communicates with the groove 9. The guide groove 11 opens at the upper surface of the case 10, and has chamfered surfaces 12*a*, 12*b*, and 12*c* so that the guide groove 11 becomes wider nearer the upper surface of the case 10. The guide groove 11 guides a later described cylindrical projection 17 of the printhead 5 into the guide groove 9.

Figure 3:
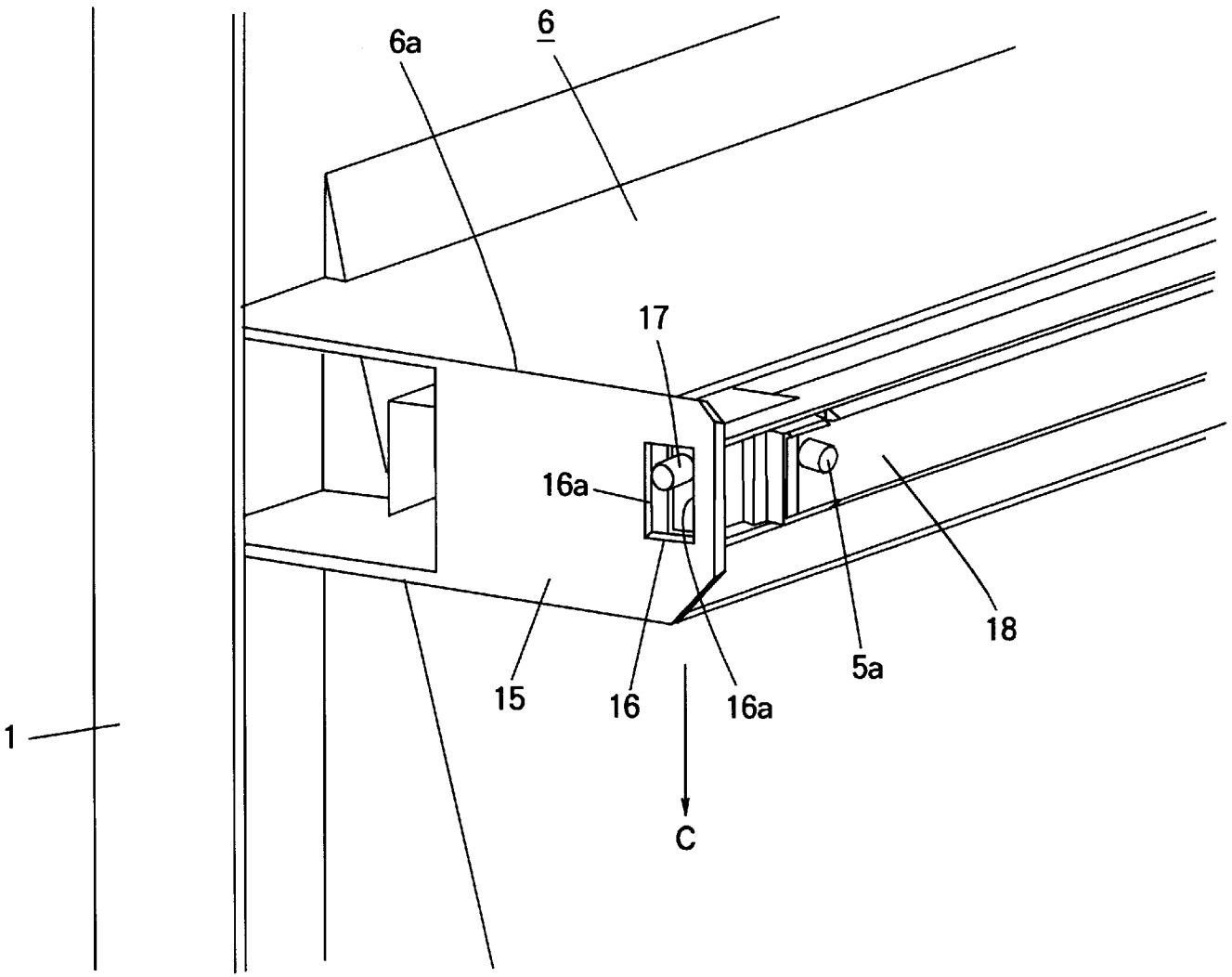
FIG. 3 is a perspective view showing the configuration of the housing of the printhead assembly of the first embodiment.

The print process cartridge 7 has a longitudinally extending surface 13 which abuts a part of the surface 18 of the printhead 5 when the lid 1 is completely closed. Light is transmitted through the surface 18 to illuminate the photoconductive drum assembled in the process cartridge 7 in accordance with print data. The flat, horizontal surface 13 is formed with recesses 14 therein at longitudinal end portions thereof. The recesses 14 fittingly receive the projections 5*a* of the printhead 5 therein. The recesses 14 are deep enough to receive the projection 5*a* therein so that when the cylindrical projection 17 see FIG. 3 is guided along the guide grooves 9, the printhead 5 is smoothly positioned relative to the print process cartridge 7. The projections 5*a* have chamfered ends and the recesses 14 have chamfered edge at their entrance such that the projections 5*a* are smoothly guided into the recesses 14.

FIG. 3 is a perspective view, showing the construction of the housing 6*a* of the printhead assembly 6 of the first embodiment. FIG. 3 shows only a left half of the apparatus.

Figure 4:
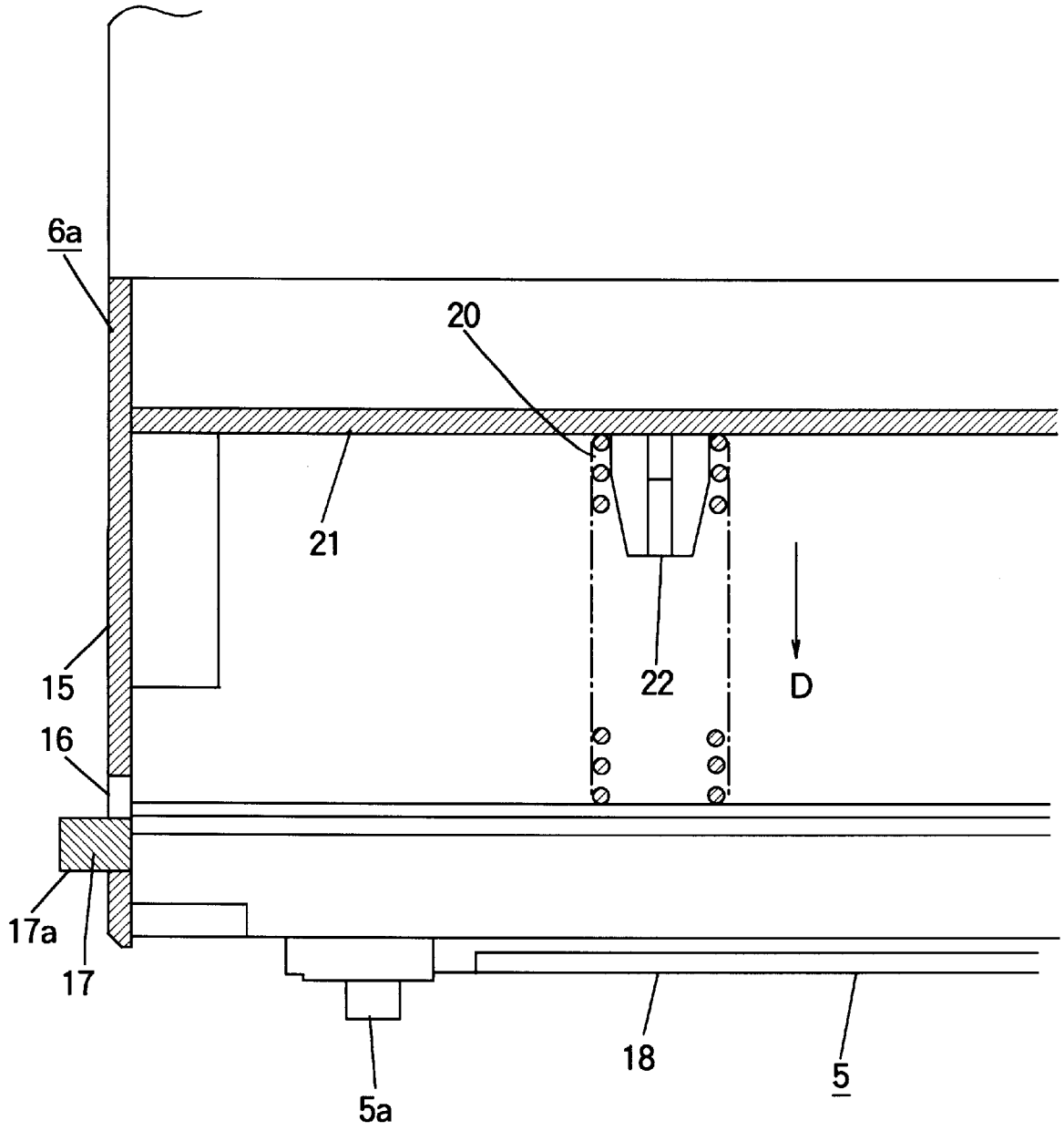
FIG. 4 is a cross-sectional view of the printhead and the housing.

FIG. 4 is a cross-sectional view of the printhead 5 and the housing 6*a,* showing only a left half of the apparatus.

As is clear from FIG. 1, the printhead 5 and the housing 6*a* are symmetric with respect to a vertical plane passing through the main body 3.

Referring to FIGS. 3 and 4, a side plate 15 of the housing 6*a* has a rectangular hole 16 formed therein. The printhead 5 has the cylindrical projection 17 at each longitudinal end of the printhead 5. The printhead 5 is installed in the housing 6*a* with the abutting surface 18 exposed and the projections 5*a* projecting outwardly. The cylindrical projection 17 extends laterally through the rectangular hole 16. The printhead 5 is loosely movable in the housing 6*a* in a direction shown by arrow C (FIG. 3).

When the lid 1 is rotated in the direction shown by arrow B of FIG. 1, the cylindrical projection 17 enters the guide groove 9 through the guide 11.

After the projections 17 on both ends have entered the guide grooves 9 through the guides 11, the projections 17 move straight along the long sides of the hole 16 in a direction shown by arrow D as the lid 1 further rotates about the shafts 4 along the arcuate path. Therefore, the distance of the projection 17 from the shaft 4 is shorter when the projection moves along the guide groove 9 than when the projection 17 is not guided along the guide groove 9.

In other words, the projection 17 moves within the hole 16 over a distance corresponding to the aforementioned difference in the distance between the shaft 4 and the projection 17.

Thus, the long sides 16*a* of the hole 16 are selected to be long enough to accommodate the movement of the projection 17 corresponding to the difference in the distance of the projections 17 from the shafts 4.

As shown in FIG. 4, the compression spring 20 is disposed near the side plate of the housing 6*a* and urges the printhead 5 in a direction shown by arrow D. One end of the compression spring 20 firmly fits over a boss 22 projecting from an inner wall 21 of the housing 6*a* and the other end of the compression spring 20 abuts the rear end of the printhead 5. The compression spring 20 urges the printhead 5 in the direction shown by arrow D at all times.

<Operation>

The operation of the aforementioned image-forming apparatus will now be described.

Figure 5:
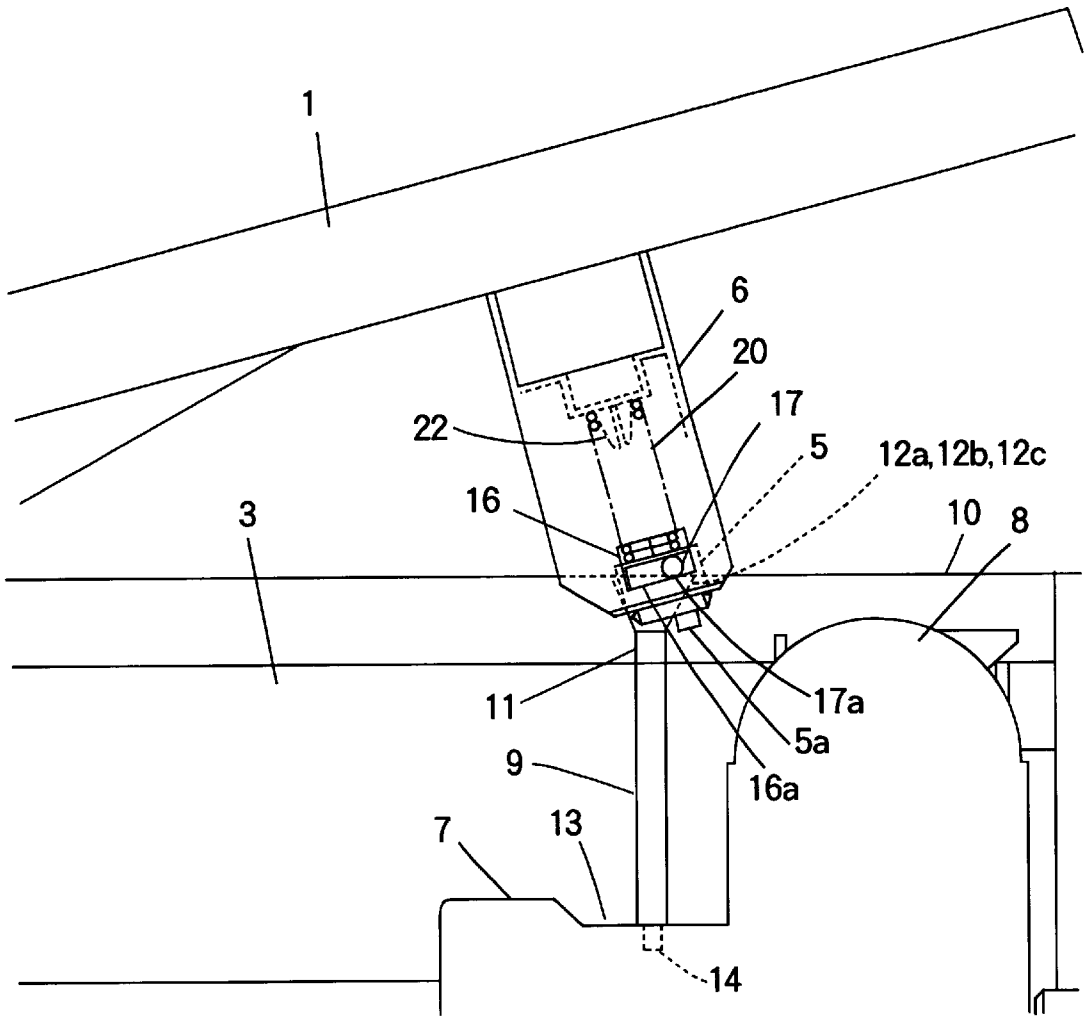
FIG. 5 is a side view illustrating the lid just before the projections enter the guides.

FIG. 5 is a side view illustrating the lid 1 just before the projection 17 enters the guide 11.

Referring to FIG. 5, as the lid 1 rotates about the shaft 4, the printhead 5 approaches the main body 3 and the projection 17 is about to enter the guide 11. Then, the printhead 5 is urged by the compression springs 20 so that the circumference 17*a* of the projection 17 is pressed against the side 16*a* that defines the hole 16.

As the lid 1 further rotates, the projection 17 is guided by the beveled surfaces 12*a,* 12*b,* and 12*c* into the guide groove 9 through the guide groove 11. Thereafter, the lid 1 continues to rotate about the shaft 4 while the projection 17 straightly goes down along the guide groove 9. The projection 17 displaces within the hole 16 while being restricted its position by the side 16*a* and the guide groove 9. The printhead 5 advances toward the print process cartridge 7.

The compression spring 20 urges the printhead 5 in the direction in which the projection 5*a* is oriented. Thus, immediately after the projection 17 has entered the guide groove 11, the printhead 5 is urged in a direction different from the direction in which the recesses 14 extend. As the lid 1 further rotates about the shafts 4, the printhead 5 is guided by the guide groove 9 to slightly tilt with respect to the housing 6*a,* so that the projection 5*a* become oriented in directions closer to the direction in which the recesses 14 extend. Immediately before the projection 5*a* finally fits into the recess 14, the projection 5*a* extends in the same direction as the recess 14. Thus, the abutting surface 18 of the printhead 5 comes into contact with the abutting surface 13 of the print process cartridge 7.

Figure 6:
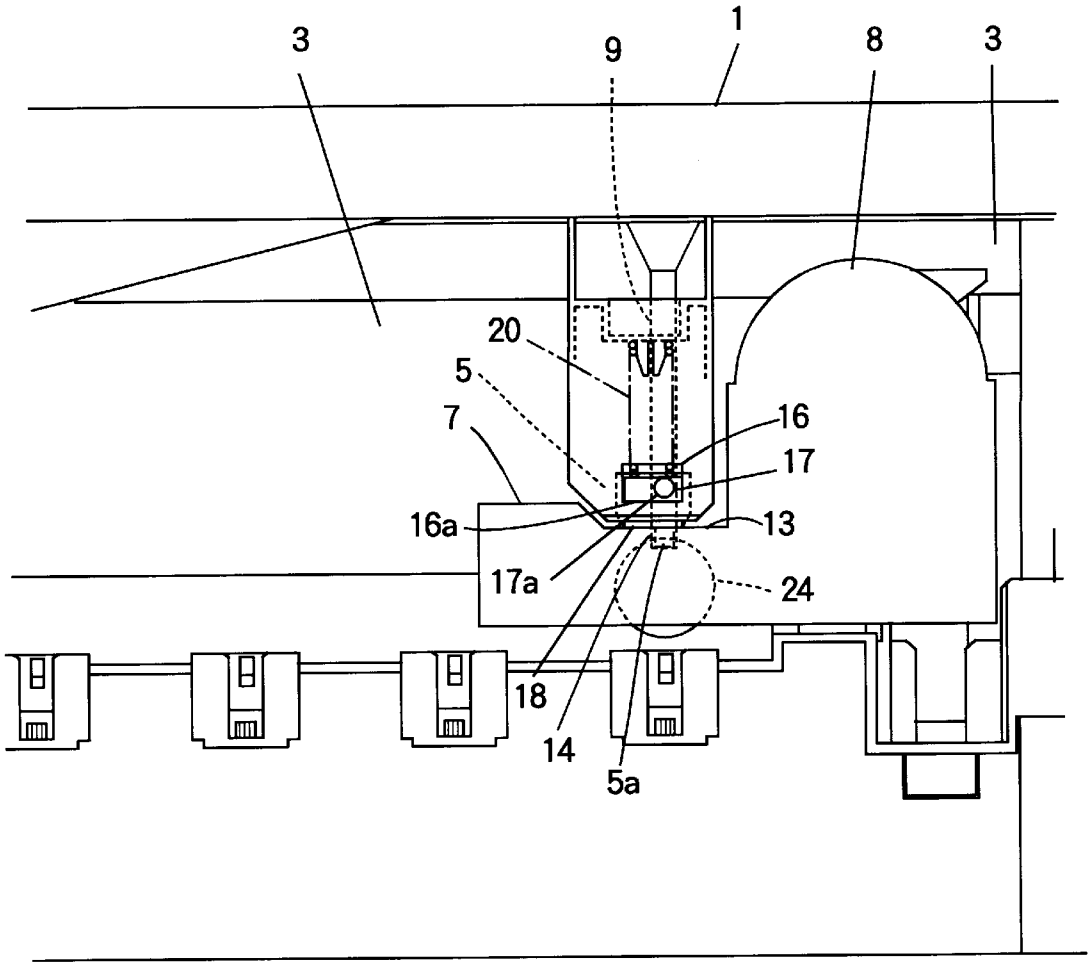
FIG. 6 is a perspective view of an essential part of a second embodiment.

FIG. 6 is a side view of the apparatus when the lid 1 has been closed completely.

When the lid 1 is completely closed, the compression spring 20 properly urges the printhead 5 against the print process cartridge 7 such that no other force than the urging force of the spring 20 presses the abutting surface 18 of the printhead 5 against the abutting surface 13 of the print process cartridge 7.

Figure 7:
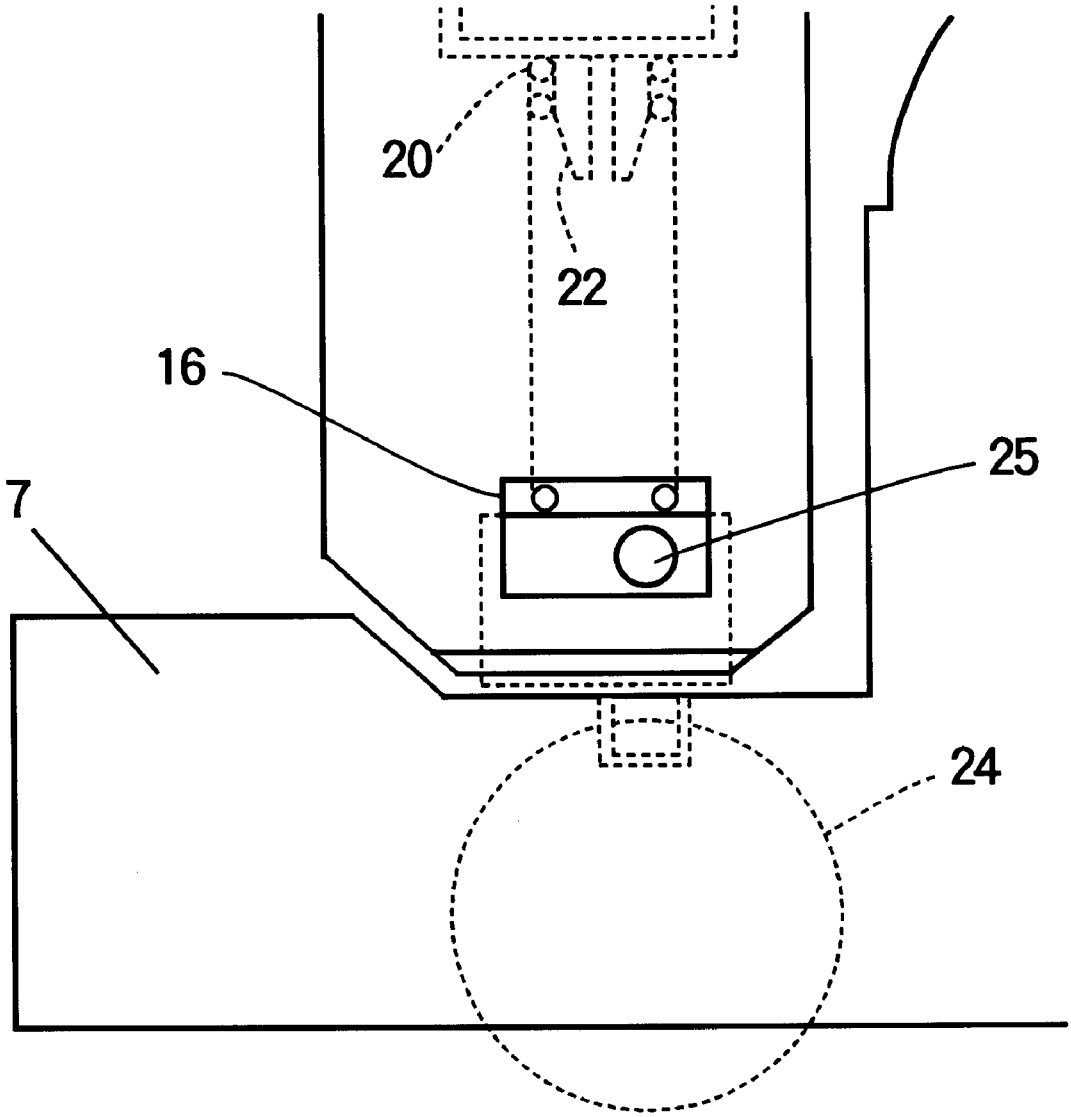
FIG. 7 illustrates the printhead when it has completely moved into mating engagement with the print process cartridge.

FIG. 7 illustrates the printhead 5 when it has completely moved into mating engagement with the print process cartridge 7. As is clear from FIG. 7, once the printhead 5 has completely moved into mating engagement with the print process cartridge 7, the circumference 17*a* of the projection 17 is out of abutting engagement with the side 16*a* of the hole 16. The projections 17 provided on both longitudinal ends of the printhead 5 are in the guide grooves 9 formed in the inner wall surfaces of the main body 3. The pair of projections 5*a* of the printhead 5 are fitted into the corresponding recesses 14 formed in the abutting surface 13 of the print process cartridge 7, thereby the printhead 5 being accurately positioned with respect to the print process cartridge 7 and the photoconductive drum 24.

The first embodiment eliminates the need for shaping the housing 6*a* such that the orientation of the printhead 5 gradually varies as the lid 1 rotates about the shafts 4, thereby simplifying the shape of a portion of the housing that holds the printhead 5. In addition, the simple coil-shaped compression spring 20 reduces the manufacturing cost.

Second Embodiment

<Construction>

Figure 8:
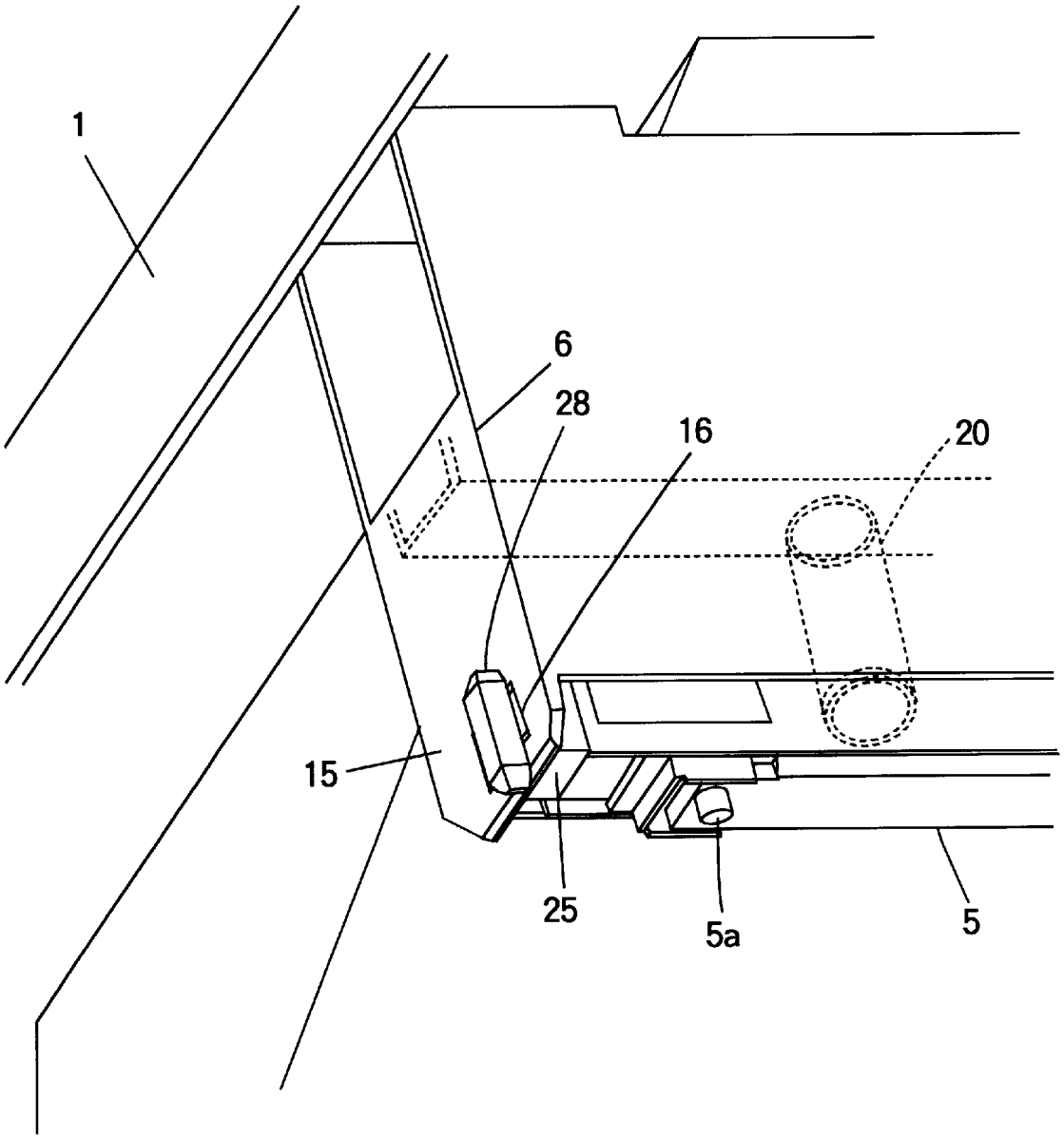
FIG. 8 is a perspective view of an essential part of a second embodiment.

FIG. 8 is a perspective view of an essential part of a second embodiment.

Figure 9:
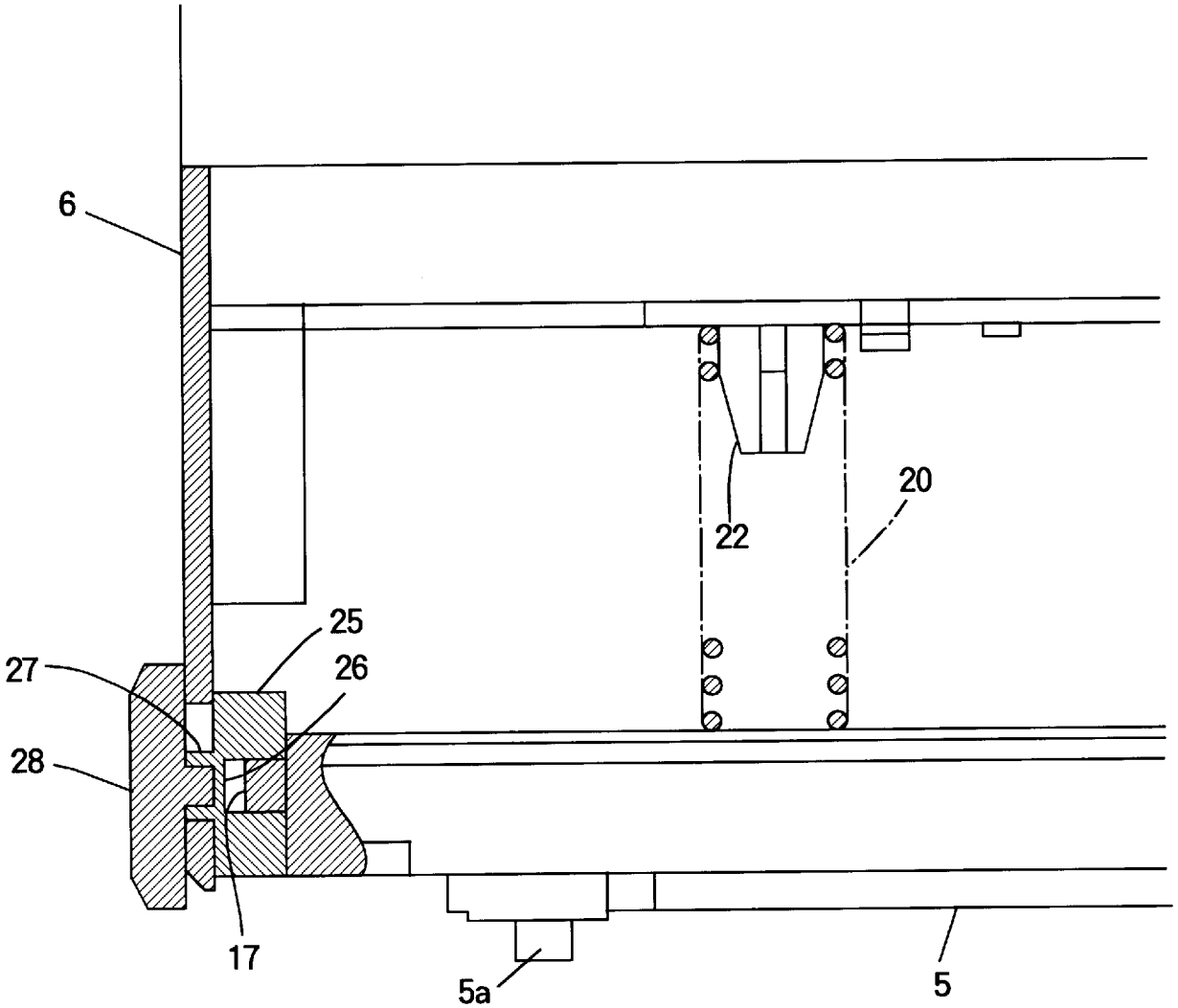
FIG. 9 is a cross-sectional view of the printhead and the housing.

FIG. 9 is a cross-sectional view of the printhead 5 and the housing 6*a.*

The construction is symmetrical with respect to a center vertical plane and therefore only a left side is shown.

The second embodiment differs from the first embodiment in that a projection 28 is used in place of the cylindrical projection 17. Elements similar to those of the first embodiment have been given the same reference numerals and the description thereof is omitted.

Referring to FIGS. 8 and 9, a housing 6*a* is fixedly mounted on the underside of the forward portion of the lid 1. The housing 6*a* has two opposed side plates 15 each of which is formed with a rectangular hole 16. The printhead 5 is provided with projections 17 at its longitudinal ends thereof. The projection 17 fits into the recess 26 formed in the support 25 so that the support 25 is in integral with the printhead 5. The support 25 has a rectangular projection 27 that is provided on an outer surface of the support 25 and extends through the hole 16. Thus, the housing 6*a* supports the printhead 5 such that the printhead 5 is loosely movable in the housing 6*a*. A strip-shaped guide piece 28 is mounted to the free end of the projection 27 such that the guide piece 28 is oriented in the direction in which the groove 9 extends. The projection 17, the guide piece 28, and the hole 16 form a guide mechanism.

<Operation>

The operation of an image-forming apparatus of the aforementioned construction will be described.

Figure 10:
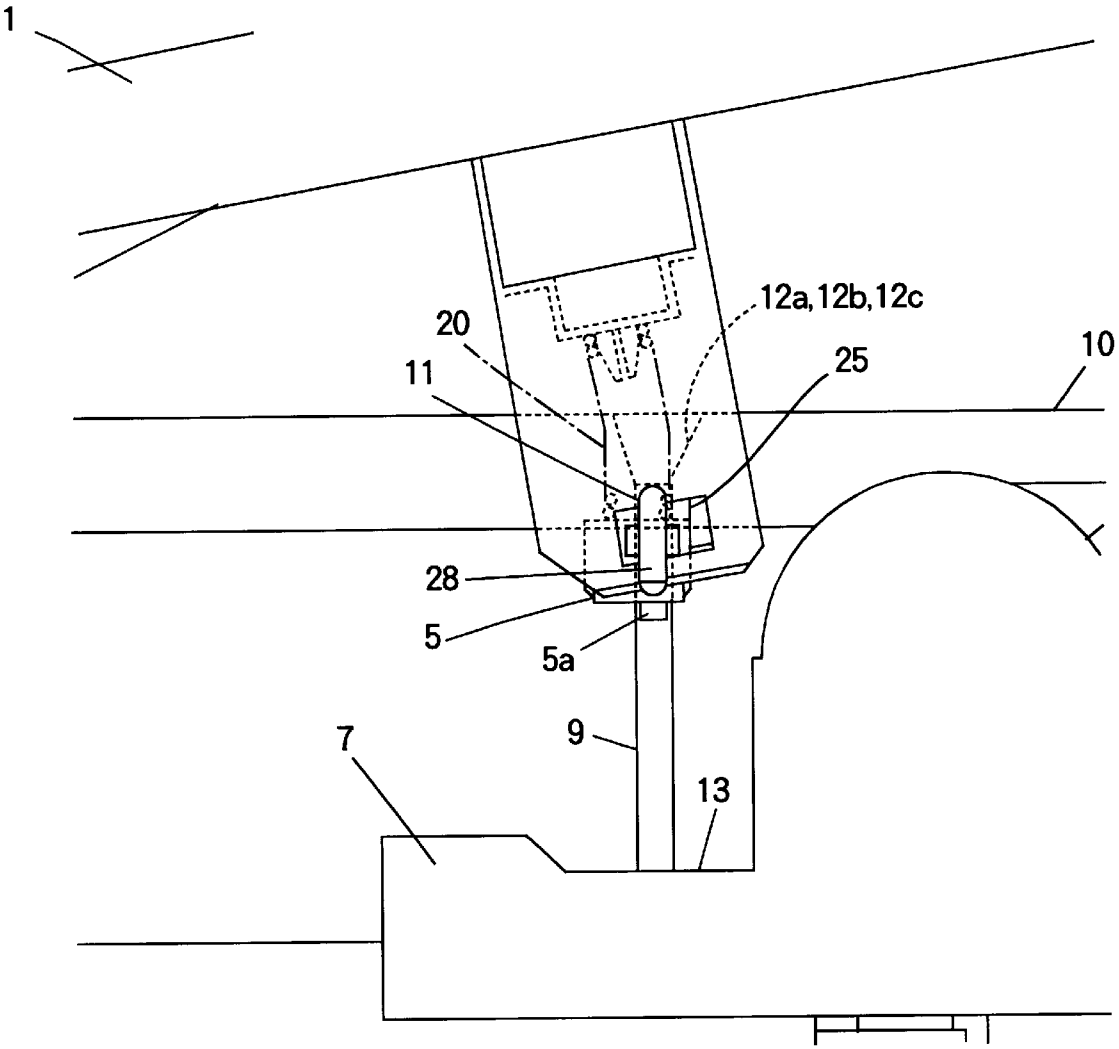
FIG. 10 is a side view of the image-forming apparatus when the lid is rotating about the shafts so that the printhead moves along an arcuate path.

FIG. 10 is a side view of the image-forming apparatus when the lid 1 is rotating about the shafts 4 so that the printhead 5 moves along an arcuate path.

Referring to FIG. 10, when the lid 1 rotates to close the main body 3, the guide piece 28 slides on the chamfered surfaces 12*a*, 12*b*, and 12*c* formed in the lateral member 10 into the guide groove 11. The guide groove 11 in turn guides the guide piece 28 into the guide groove 9 formed in the main body 3. The guide piece 28 cooperates with the guide groove 9 to properly orient the printhead 5 with respect to the print process cartridge 7, so that the printhead 5 is vertically lowered with the abutting surface 18 extending parallel with the abutting surface 13 of the print process cartridge 7. The guide piece 28 is more effective in accurately orienting the exposing unit 5 in the printhead 5 with respect to the print process cartridge 7. Thus, the projections 5*a* move straight in a direction perpendicular to the abutting surface 13 of the print process cartridge 7, finally fitting into the recesses 14 formed in the abutting surface 13.

As is clear from FIG. 9, the one end of the spring 20 urges against the rear of the printhead 5. Thus, when the guide piece 28 enters the groove 9, the coil spring 20 is deformed to follow the movement of the printhead 5, while at the same time urging the printhead 5. The coil spring 20 is resiliently slightly bent as shown in FIG. 10. As the printhead 5 further advances downward into the main body 3, the spring 20 gradually regains its original shape. Once the abutting surface 18 of the printhead 5 has moved into contact engagement with the abutting surface 13 of the print process cartridge 7, the spring 20 urges the printhead 5 in a direction normal to the rear surface of the printhead 5.

The construction of the second embodiment allows the printhead 5 to move in a straight direction after the projection 28 has entered into the groove 9. The straight movement of the printhead 5 allows the clearances between the print process cartridge 7 and the surroundings to be minimum, leading to miniaturizing the image forming apparatus.

The guide piece 28 may be provided directly on the projection 17 of the printhead 5 without using the support 25.

Third Embodiment

<Construction>

Figure 11:
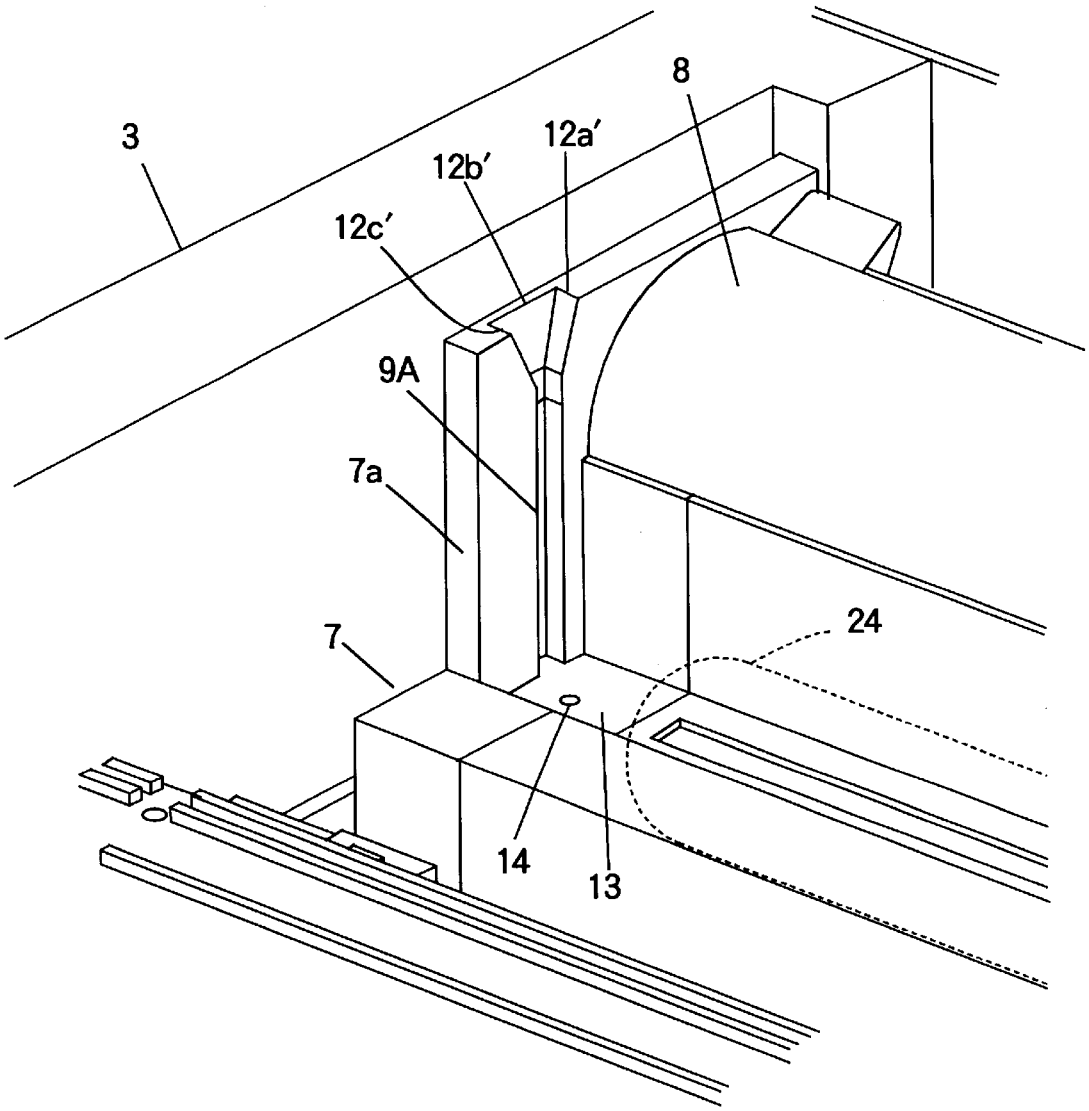
FIG. 11 is a perspective view of an image-forming apparatus according to a third embodiment.

FIG. 11 is a perspective view of an image-forming apparatus according to a third embodiment. Just as in the first embodiment, the apparatus is symmetrical with respect to a center vertical plane passing through the main body 3.

Figure 20:
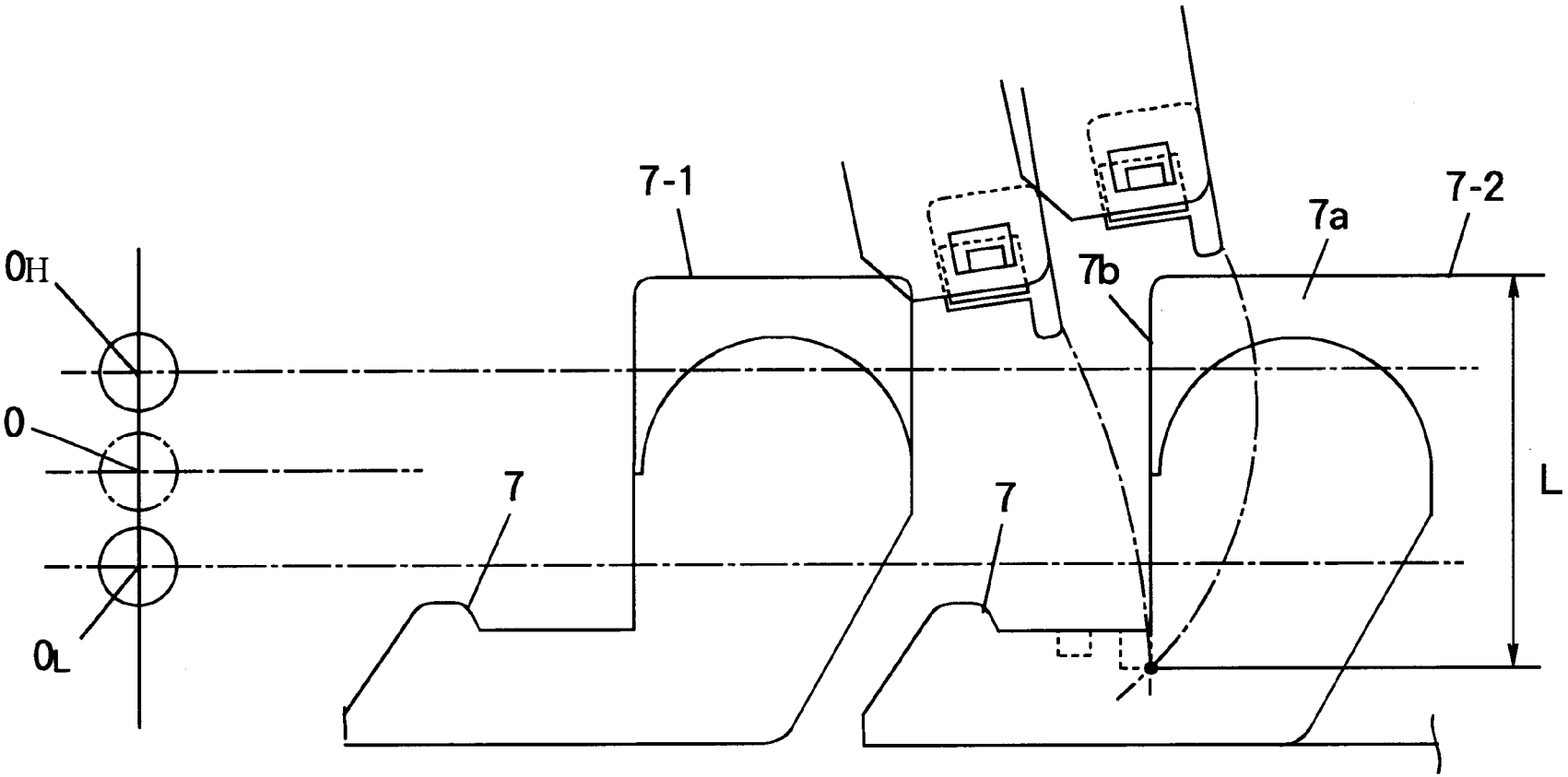

Referring to FIG. 20, the third embodiment differs from the first embodiment in that side walls 7*a* are provided at left and right ends of a toner cartridge 8 and rise from the abutting surface 13. The side walls 7*a* have guide grooves 9A formed in an inner surface thereof. The guide grooves 9A are similar to those in the first embodiment and serves as a part of a guiding mechanism that guides the printhead 5 to the print process cartridge 7.

The guide groove 9A is in communication with a space defined by chamfered surfaces 12*a'*, 12*b'*, and 12*c'* so that the printhead 5 is smoothly guided into the guide groove 9A. The abutting surface 13 is formed with a recess 14 therein that receives a projection 5*a* on the printhead 5. The housing 6*a* is of the same construction as the first embodiment and holds the printhead 5 therein.

<Operation>

The operation of the image-forming apparatus of the aforementioned construction will be described.

Figure 12:
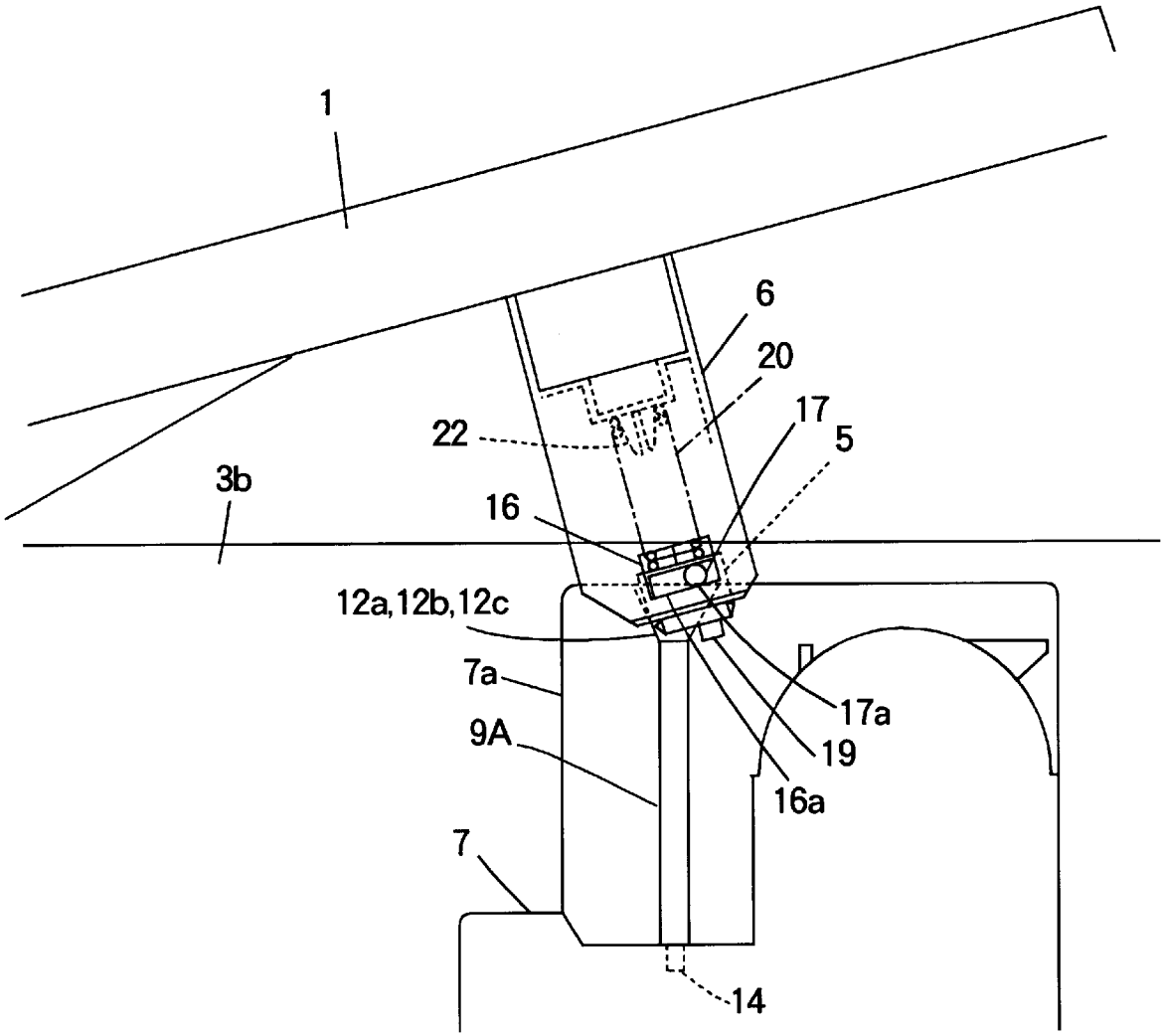
FIG. 12 is a side view of the apparatus when the lid is moving in an arcuate path.

FIG. 12 is a side view of the apparatus when the lid 1 is moving in an arcuate path.

Referring to FIG. 12, the projection 17 projects from the side surface of the printhead 5 and extends through the rectangular hole 16 formed in the side plate 15 of the housing 6*a*. Thus, the printhead 5 is held in the housing 6*a* and is loosely movable therein. The coil spring 20 firmly fits over a boss 22 and urges the printhead 5 so that the circumference 17*a* of the projection 17 abuts the side 16*a* of the hole 16. When the printhead 5 approaches the opening 3*b* of the main body 3 as the lid 1 rotates in the closing direction, the projection 17 is guided by the chamfered surfaces 12*a'*, 12*b'*, and 12*c'* into the guide groove 9.

While the lid 1 continues to rotate, the printhead 5 is lowered into the main body 3 due to the fact that the projection 17 is guided along the guide groove 9. The movement of the projection 17 is restricted by the side 16*a* and the walls of the guide groove 9. While being urged by the coil spring 20, the printhead 5 further moves to a position where the printhead 5 completely engages the print process cartridge 7 into an integral structure.

Until just before the projection 17 is guided into the guide groove 9A, the coil spring 20 urges the printhead 5 in the direction in which the projections 5*a* project. When the projection 17 is guided by the chamfered surfaces 12*a*, 12*b*, and 12*c*, the coil spring 20 urges the printhead 5 in a direction slightly different from the direction in which the recesses 14 extend. However, as the lid 1 further rotates in the closing direction, the printhead 5 slightly rotates so that the coil spring 20 urges in a direction much closer to the direction in which the recess 14 extend. Just before the projection 5*a* fits into the recesses 14, the coil spring 20 finally urges the printhead 5 so that projections 5*a* extend in the same direction as the recesses 14. Then, the abutting surface 18 of the printhead 5 presses the abutting surface 13 of the print process cartridge 7.

Figure 13:
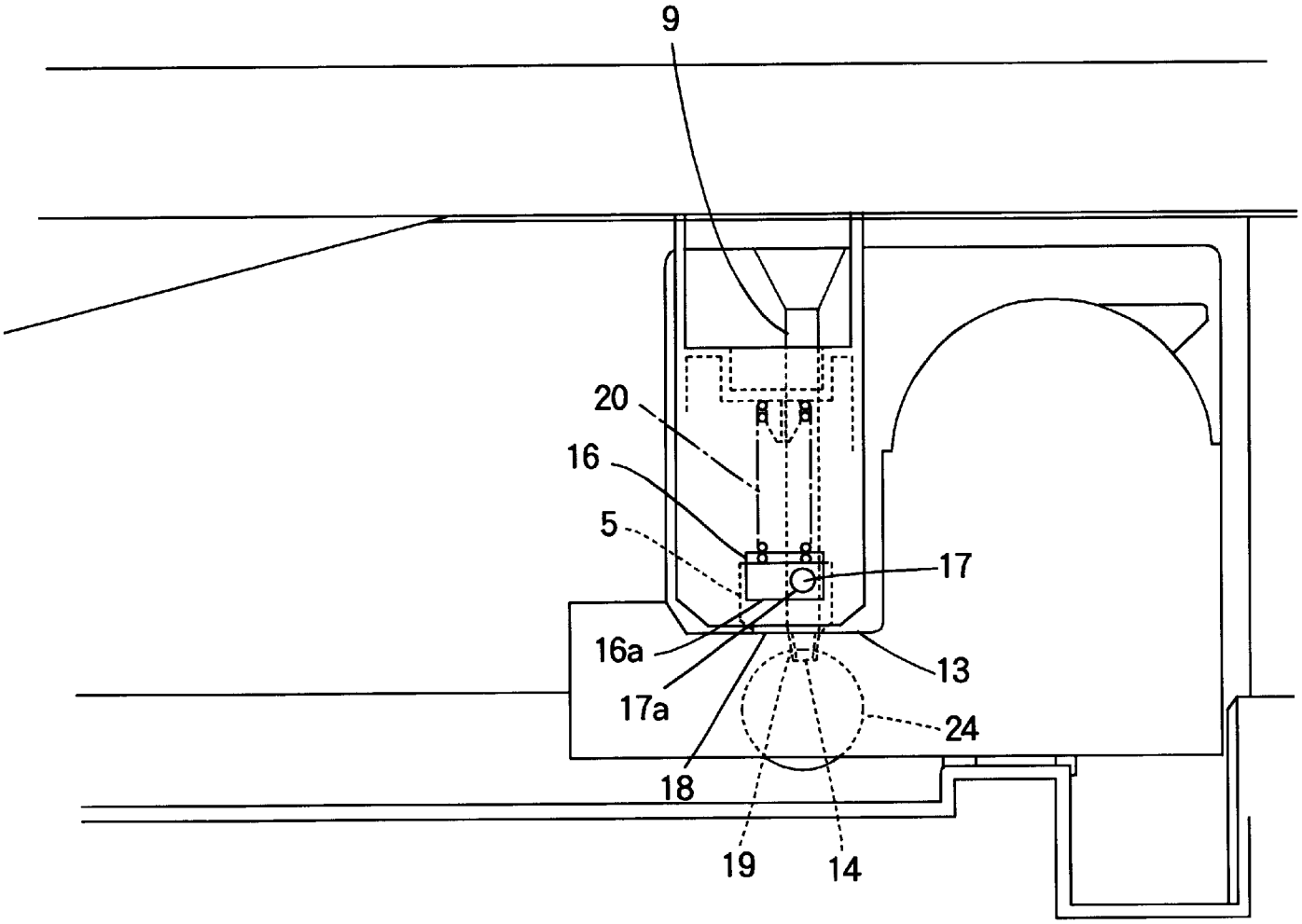
FIG. 13 is a side view of the apparatus when the lid has been closed completely.

FIG. 13 is a side view of the apparatus when the lid 1 has been closed completely.

Referring to FIG. 13, the projection 17 provided at each longitudinal end of the printhead 5 is guided into the guide groove 9. A projection 19 (FIG. 14) formed on the abutting surface 18 of the printhead 5 has completely fitted into the recess 14 formed in the abutting surface 13 of the print process cartridge 7. In this manner, the printhead 5 is placed in position with respect to the print process cartridge 7. The print head 5 is now accurately at a predetermined distance from a photoconductive drum 24. The coil spring 20 resiliently urges the printhead 5 such that the projection 17 is not in contact with any sides of the hole 16 and prevents the printhead 5 from rattling.

The third embodiment eliminates the need for designing the shape of the housing 6*a* such that the orientation of the printhead varies as the lid 1 rotates. Therefore, the structure of the housing 6*a* that supports the printhead 5 can be of a simple shape accordingly. In addition, the coil spring 20 can also be of a simple cylindrical shape, leading to reduction of cost of the apparatus.

Since the guide grooves 9A and recesses 14 are formed in the print process cartridge 7, manufacturing errors and assembly errors of other parts of the apparatus will not affect the positional relation between the printhead 5 and the print process cartridge 7. This is particularly advantageous when a plurality of print process cartridges are incorporated in an image-forming apparatus such as a color electrophotographic printer, each printhead can be positioned relative to a corresponding print process cartridge independently of the other print process cartridges. The third embodiment provides an electrophotographic printer where consistent print results are obtained without color shift.

Fourth Embodiment

<Construction>

Figure 14:
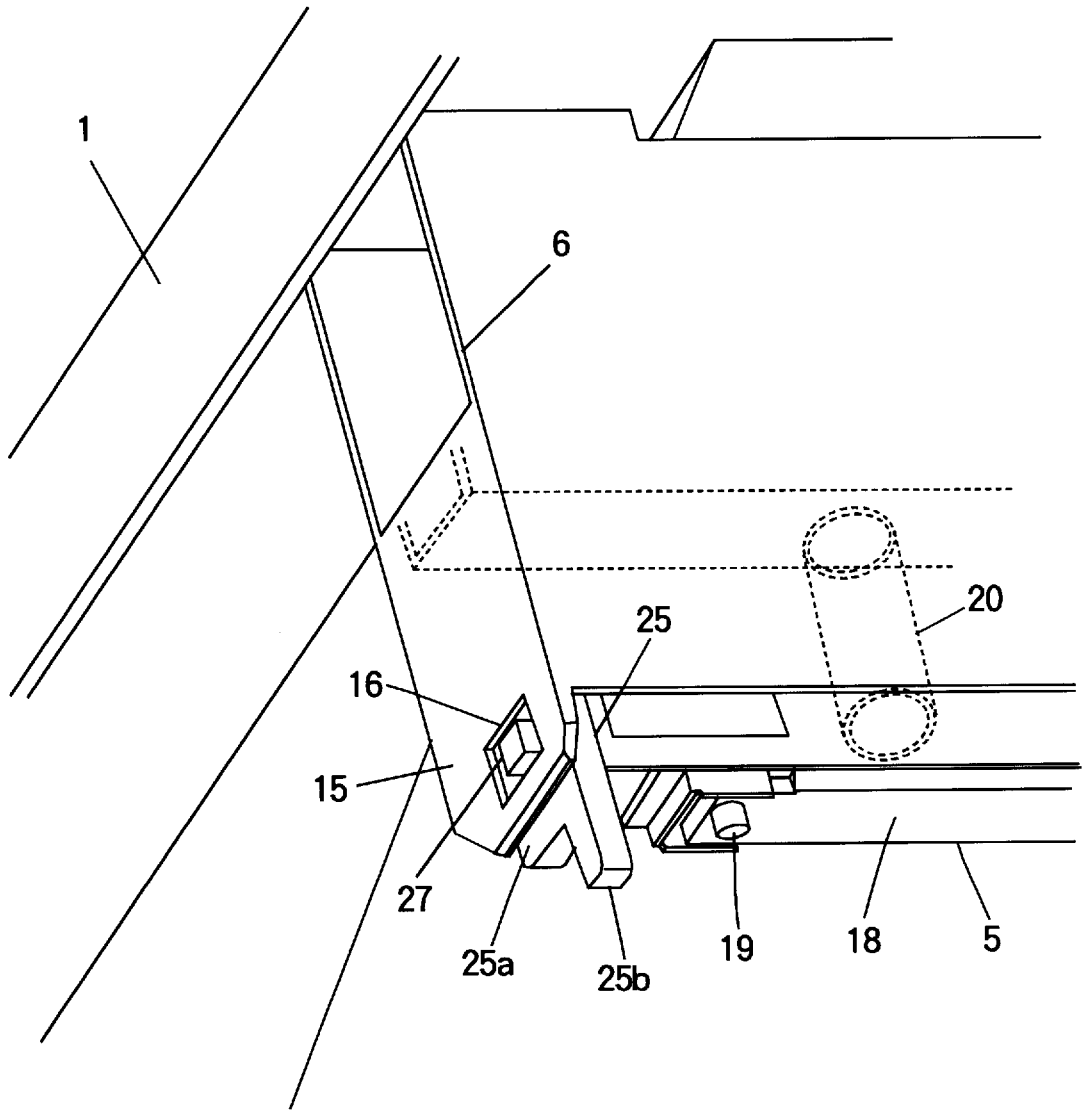
FIG. 14 is a perspective view of an essential part of a housing according to a fourth embodiment.

FIG. 14 is a perspective view of an essential part of a housing 6*a* according to a fourth embodiment.

Figure 15:
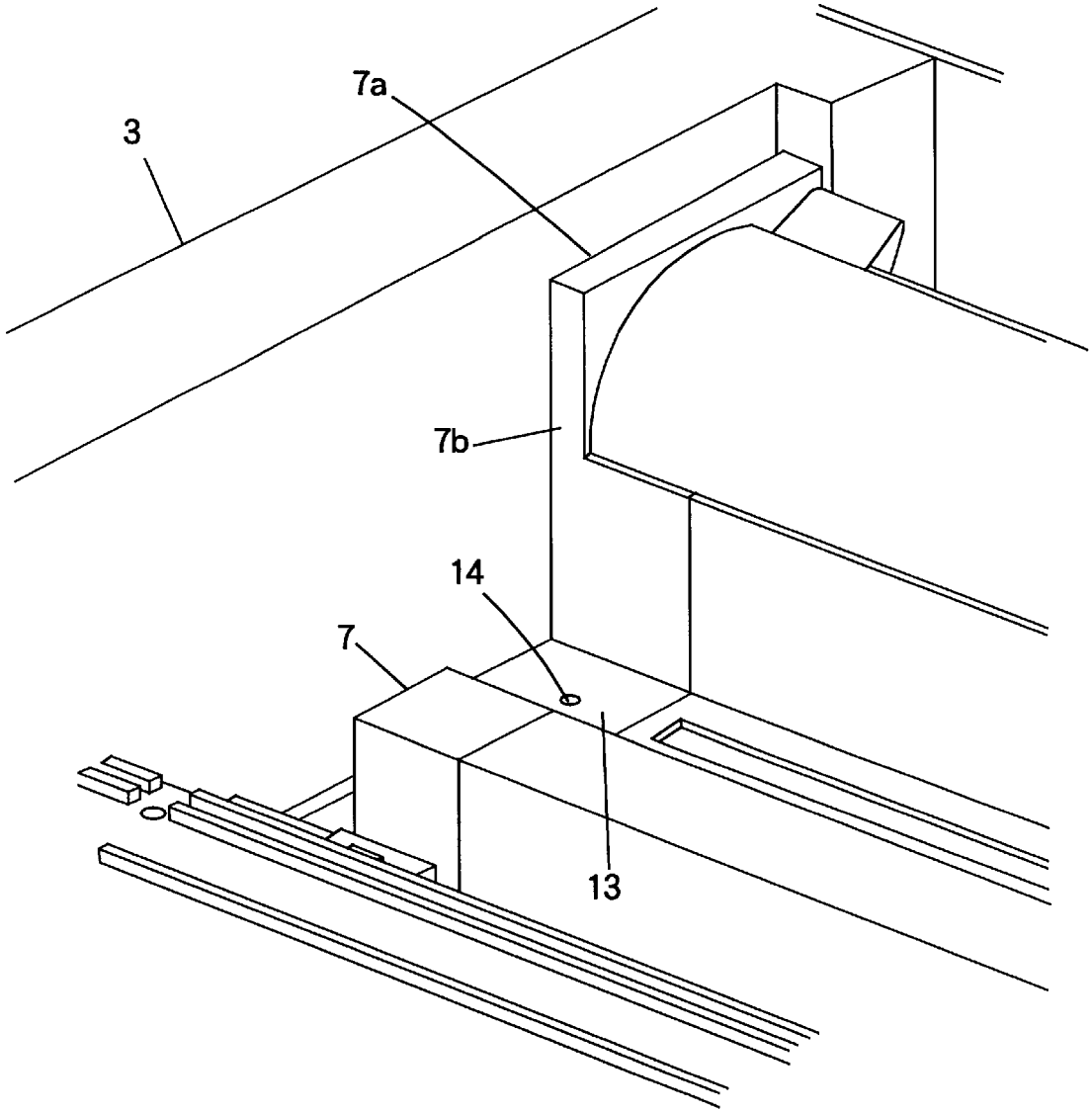
FIG. 15 is a perspective view of the print process cartridge assembled into the main body.

FIG. 15 is a perspective view of the print process cartridge 7 assembled into the main body 3.

Figure 16:
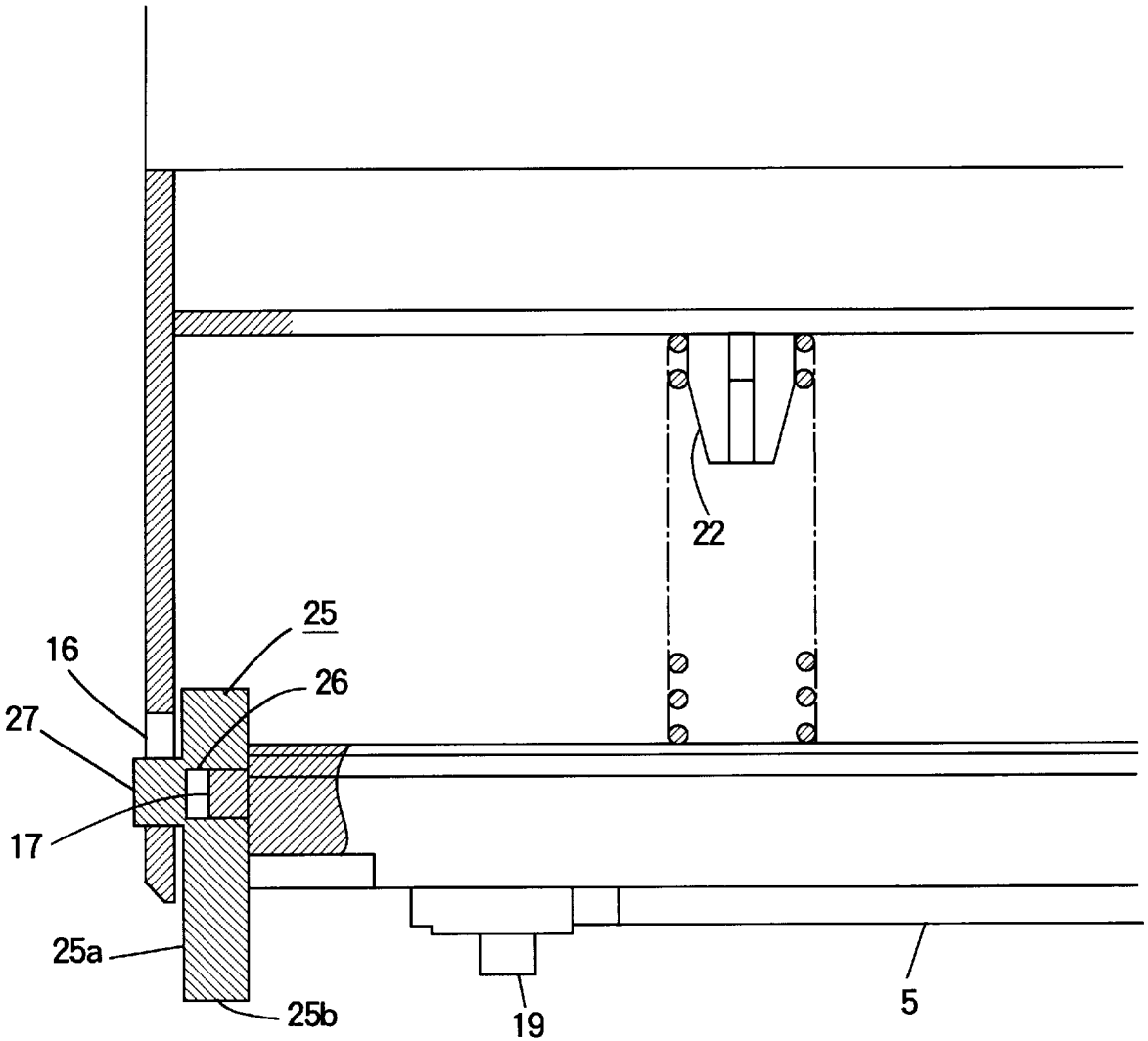
FIG. 16 is a cross-sectional view of the printhead and the housing.

FIG. 16 is a cross-sectional view of the printhead 5 and the housing 6*a*.

The construction is symmetric with respect to a center vertical plane of the image forming apparatus and therefore only a left side is shown. Elements corresponding to those of the third embodiment have been given the same reference numerals and the description thereof is omitted.

The fourth embodiment differs from the third embodiment in that a wall 7*b* rises from the abutting surface 13 of the print process cartridge 7 as shown in FIG. 15. The fourth embodiment also differs from the third embodiment in that a support 25 has a second projection 25*b* that projects in a direction normal to the abutting surface 18 of the print head 5 as shown in FIGS. 14 and 15. The wall 7*b* and the second projection 25*b* form a guiding mechanism that guides the printhead 5 into accurate mating engagement with the print process cartridge 7.

Referring to FIGS. 14–16, the housing 6*a* is fixedly mounted to the forward underside of the lid 1. The housing 6*a* holds the printhead 5 therein, which is loosely movable in the housing 6*a*. Each of the opposed side plates 15 of the housing 6*a* is formed with a rectangular holes 16 therein.

The support 25 has a first projection 27 that extends into the rectangular hole 16 formed in the side plate 15. The support 25 is also formed with a recess 26 in a side wall 25*a* thereof. The recess 26 firmly receives the projection 17 (FIG. 25) that projects from the printhead 5 so that the support 25 is integral with the printhead 5. As shown in FIG. 14, the second projection 25*b* extends in a direction normal to the abutting surface 18 of the printhead 5. The end surface 7*b* of the side wall 7*a* of the print process cartridge 7 lies in a plane perpendicular to the abutting surface 13 of the print process cartridge 7.

<Operation>

The operation of the image-forming apparatus of the aforementioned construction will be described.

Figure 17:
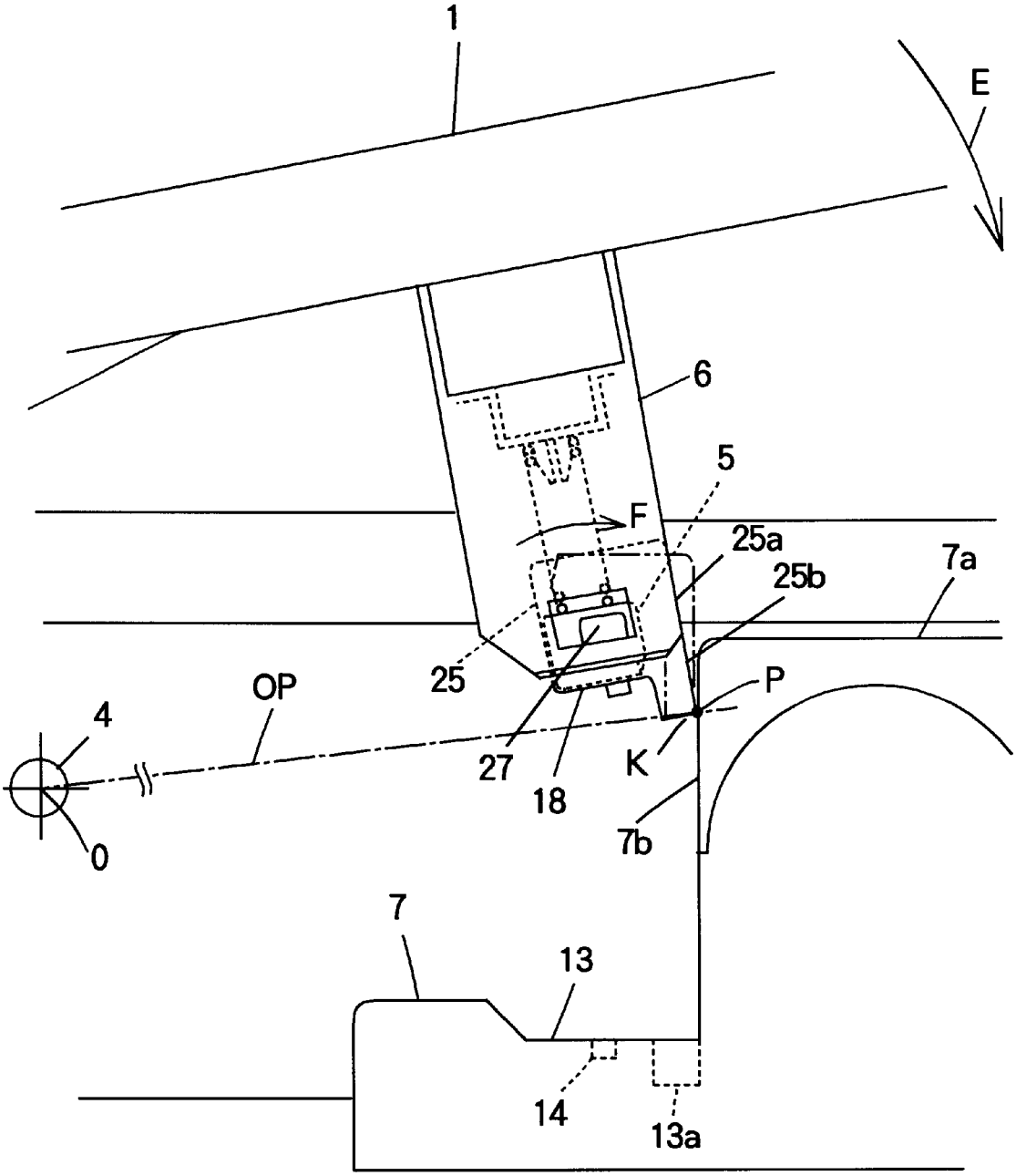
FIG. 17 is a side view of the apparatus when the lid is rotating.

FIG. 17 is a side view of the apparatus when the lid 1 is rotating.

Figure 18:
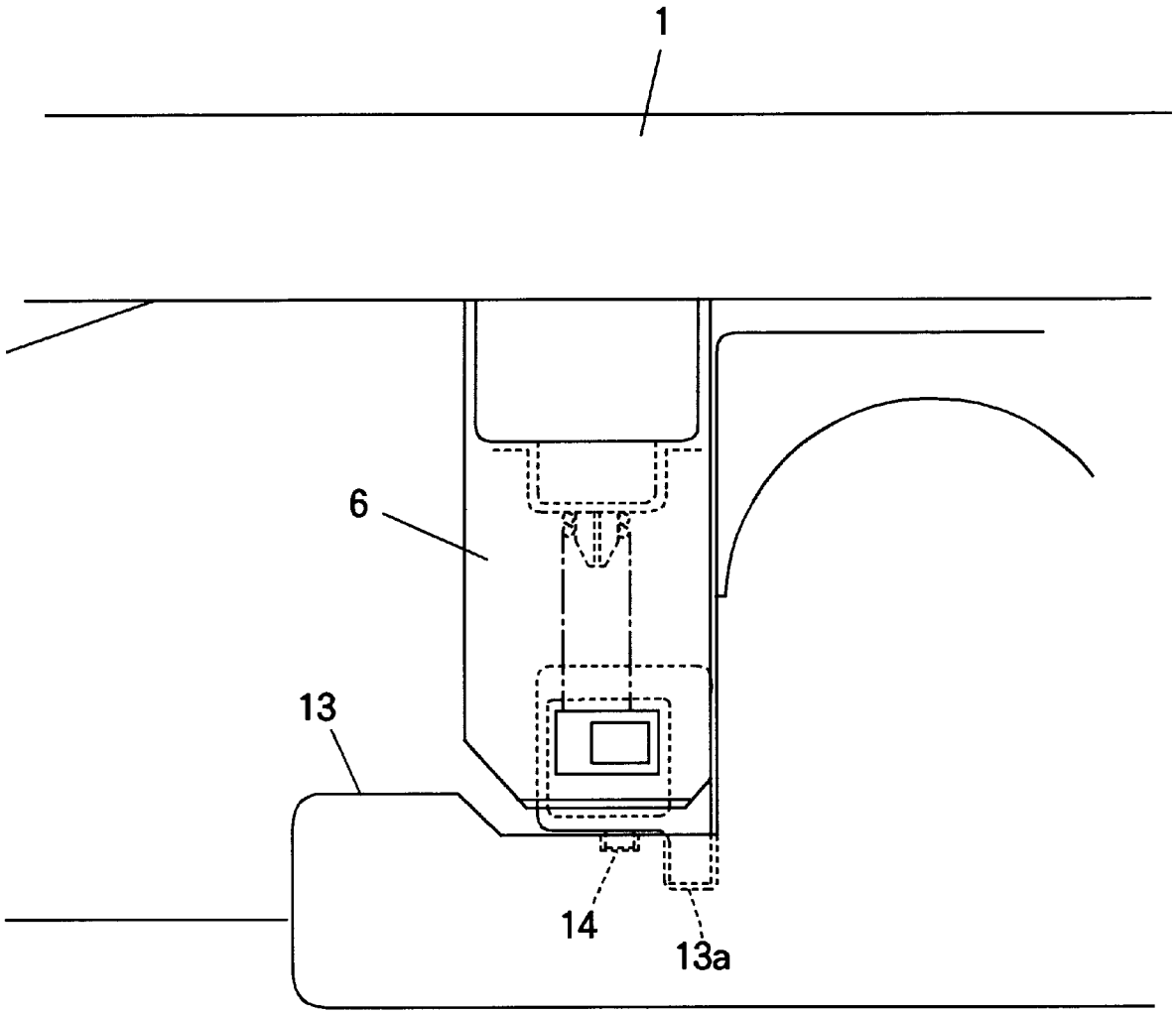
FIG. 18 is a side view when the lid 1 is completely closed.

FIG. 18 is a side view when the lid 1 is completely closed.

Referring to FIG. 17, as the lid 1 rotates about the shaft 4 in a direction shown by arrow E, the support 25 approaches the print process cartridge 7. As the lid 1 further rotates, a corner K of the projection 25*b* abuts point P on the end surface 7*b*. The support 25 is above a line OP that connects from an axis O of the shaft 4 to point P, and the projection 27 of the support 25 is loosely received in the hole 16. Therefore, as the lid 1 further rotates after the projection 25*b* abuts point P on the end surface 7*b*, the support 25 rotates about a corner K of the projection 25*b* in a direction shown by arrow F, while also sliding on the end surface 7*b*. The support continues to rotate until the projection 25*b* extends parallel to the surface 7*b* and the projection 25*b* fits into the recess 13*a* formed in the abutting surface 13 as shown in FIG. 26. Then, the abutting surface 18 of the printhead 5 finally becomes in pressure contact with the abutting surface 13 of the print process cartridge 7 as shown in FIG. 18, thereby accurately positioning the printhead 5 relative to the print process cartridge 7.

The construction of the fourth embodiment converts the arcuate movement of the lid 1 into the substantially linear, vertical movement of the printhead 5. This ensures that the printhead 5 is accurately positioned with respect to the print process cartridge 7. The print process cartridge 7 may have a simple shape, and can be manufactured at low cost correspondingly.

The fourth embodiment is advantageous when a plurality of print process cartridges are incorporated in an image-forming apparatus, e.g., a color electrophotographic printer, each printhead can be positioned relative to a corresponding print process cartridge independently of the other print process cartridges and printheads. The fourth embodiment provides an electrophotographic printer where consistent print results are obtained without color shift.

Fifth Embodiment

<Construction>

Figure 19:
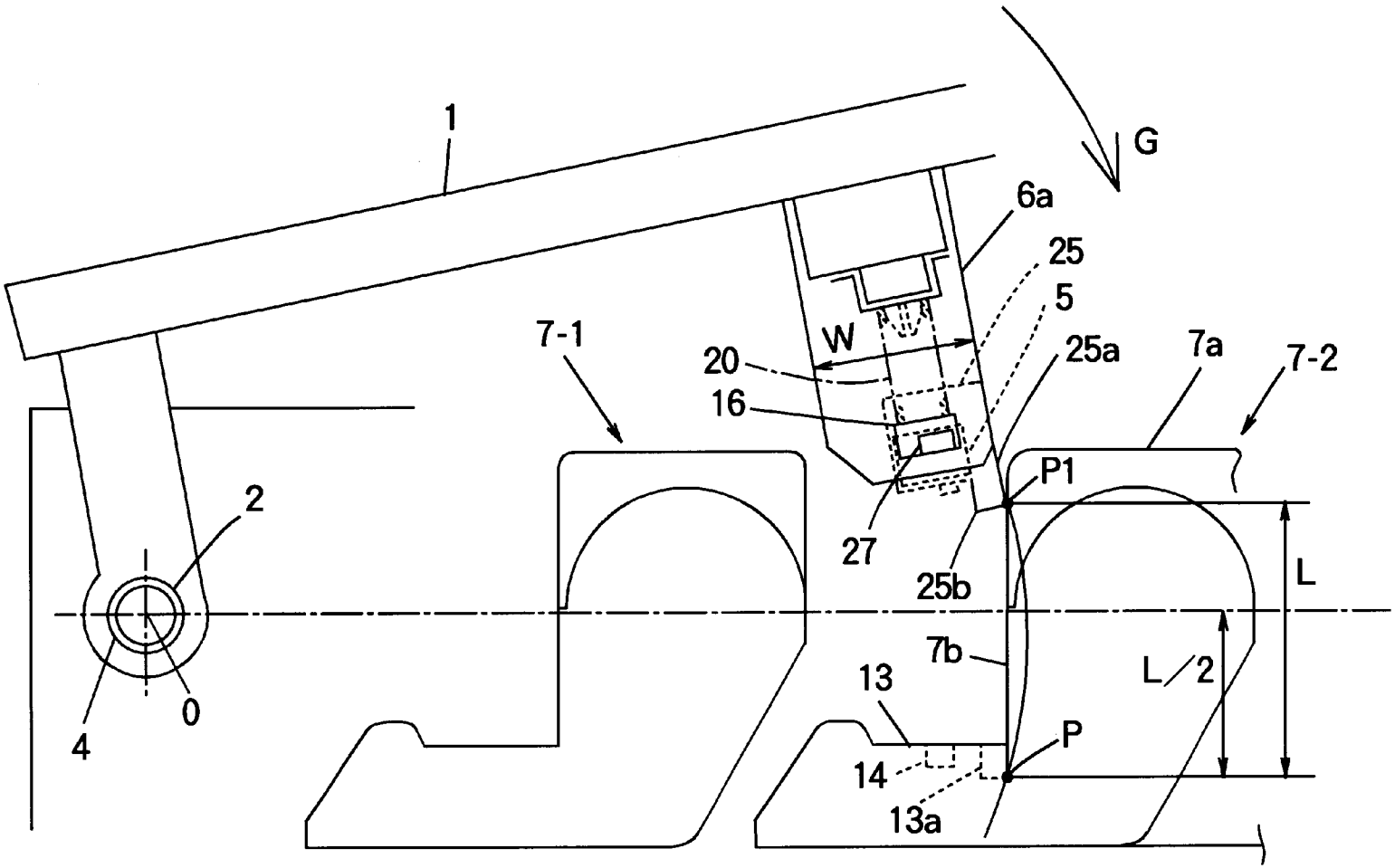
FIGS. 19 and 20 are side views of an essential part of a fifth embodiment.

FIGS. 19 and 20 are side views of an essential part of a fifth embodiment.

The construction of the fifth embodiment is basically the same as the third and fourth embodiments. The fifth embodiment is characterized in that a plurality of print process cartridges are arranged at minimum intervals in an electrophotographic color printer.

Referring to FIGS. 19 and 20, the lid 1 has holes 2 formed at its rear end portion. The shafts 4 are formed at a rear end portion of the side walls of the main body 3 and extend into the holes 2, so that the lid 1 is rotatable about the shafts 4. The lid 1 has the housing 6*a* that loosely holds the printhead 5 therein. The support 25 is formed with a recess, not shown, and a first projection 27 that extends into the rectangular hole 16 formed in the housing 6*a*. The recess firmly receives a projection, not shown, provided at a longitudinal end of the printhead 5, so that the support 25 and the printhead 5 become integral with each other. The side wall 25*a* of the support 25 has a second projection 25*b* that projects in a direction normal to the abutting surface 18 of the printhead 5. When the lid 1 is rotated about the shaft 4 to close the main body 3, the second projection 25*b* abuts the end surface 7*b* of the side wall surface 7*a* of the print process cartridge 7 before the printhead 5 engages the abutting surface 13 of the print process cartridge 7.

The end surface 7*b* of each of a plurality of print process cartridges 7 rises from the corresponding abutting surface 13.

<Operation>

The operation of an image-forming apparatus of the aforementioned construction will be described.

Referring to FIGS. 19 and 20, as the lid 1 rotates about the shaft 4 in a direction shown by arrow G, the support 25 approaches the print process cartridge 7 and then the projection 25*b* abuts the end surface 7*b* at point P1. Point P1 is at a distance L from the bottom of a recess 13*a* formed in the abutting surface 13 into which the projection 25*b* fits. The height of the axis (center) O of the hole 2 is substantially L/2 from the bottom of the recess 13*a*. This dimensional relation allows adjacent ones of the plurality of print process cartridges to be spaced apart by a minimum distance.

As shown in FIG. 19, the housing 6*a* has a predetermined width W and therefore the projection 25*b* abuts the end surface 7*b* at the point P1, then the printhead 5 can reach the abutting surface 13 without being interfered with by the print process cartridge 7. However, as shown in FIG. 20, if the axis (center) of hole 2 is at a height $O_H$ higher than the axis O, then the projection 25*b* will not abut the end surface 7*b* of the print process cartridge 7-2 but abut the top surface of the print process cartridge 7-1. In this case, the print process cartridges must be aligned at larger intervals.

On the other hand, if the axis of hole 2 is at a height $O_L$ lower than the axis O, then the projection 25*b* will not abut the end surface 7*b* of the print process cartridge 7-2 but abut the top surface thereof. In this case, too, the print process cartridges must be aligned at larger intervals.

The position of the projection 27 in the hole 16 when the projection 25*b* abuts the end surface 7*b* at point P1 is the same as that when the projection 25*b* fits into the recess 13*a*, provided that the axis O of the hole 2 is accurately positioned at a height L/2.

Therefore, the housings 6*a* can be aligned at minimum intervals in the direction in which the plurality of print process cartridges 7 are aligned.

The construction of the fifth embodiment may also be applied to the first and second embodiments.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. An image-forming apparatus, comprising:

a first assembly that accommodates a print process cartridge that has a first engagement portion, said first assembly includes an opening that opens upwards of said image-forming apparatus;

a second assembly that is rotatably supported on said first assembly so that said second assembly is rotatable about an axis to open and close the opening;

a third assembly that is mounted to an inner side of said second assembly and extends in a first direction, said third assembly including a second engagement portion that engages said first engagement portion; and a guide mechanism that guides said third assembly into a mating engagement with said print process cartridge when said second assembly rotates to close the opening, wherein said guide mechanism guides said third assembly so that said second assembly engages said first assembly.

2. The image-forming apparatus according to claim 1, wherein said print process cartridge includes a photoconductive drum, and said third assembly includes an exposing unit that illuminates said photoconductive drum to form an electrostatic latent image thereon.

3. The image-forming apparatus according to claim 1, wherein said second assembly includes:

a holder that holds said third assembly, and an urging member that urges said third assembly in a second direction against the print process cartridge when said third assembly is in the mating engagement with said print process cartridge.

4. An image-forming apparatus according to claim 1, wherein, after said second engagement portion engages said first engagement portion, said third assembly is guided into the mating engagement with said print process cartridge.

5. An image-forming apparatus according to claim 1, wherein said second engagement portion is a projection that is provided on said third assembly and said first engagement portion is a recess that is formed in said print process cartridge.

6. An image-forming apparatus comprising:

a first assembly that accommodates a print process cartridge having a first engagement portion, said first assembly having an opening at a top portion thereof;

a second assembly that is rotatably supported on said first assembly so that said second assembly is rotatable about an axis to open and close the opening;

a third assembly that is mounted to an inner side of said second assembly and extends in a first direction, said third assembly including a second engagement portion that engages said first engagement portion; and a guide mechanism that guides said third assembly into a mating engagement with said print process cartridge when said second assembly rotates to close the opening, wherein said guide mechanism guides said third assembly so that said second assembly engages said first assembly;

wherein said second assembly includes:

a holder that loosely holds said third assembly, and an urging member that urges said third assembly in a second direction against the print process cartridge when said third assembly is in the mating engagement with said print process cartridge, wherein said holder has a member that defines a hole therein, and wherein further said guide mechanism includes:

said member of the holder, a projection that projects from a longitudinal end of said third assembly and extends through the hole, and a guide that is formed in said first assembly, said guide slidably receiving the projection therein.

7. The image-forming apparatus according to claim 6, wherein said projection includes a strip-like piece that loosely fits in said guide; and wherein further said guide extends in the second direction so that, as said second assembly is rotated about the axis, said projection slides along said guide.

8. An image-forming apparatus, comprising:

a first assembly that accommodates a print process cartridge that has a first engagement portion, said first assembly includes an opening that opens upwards of said image-forming apparatus;

a second assembly that is rotatably supported on said first assembly so that said second assembly is rotatable about an axis to open and close the opening;

a third assembly that is mounted to an inner side of said second assembly and extends in a first direction, said third assembly including a second engagement portion that engages said first engagement portion; and a guide mechanism that guides said third assembly into a mating engagement with said print process cartridge when said second assembly rotates to close the opening, wherein said guide mechanism guides said third assembly so that said second assembly engages said first assembly;

wherein said second assembly includes:

a holder that loosely holds said third assembly, and an urging member that urges said third assembly in a second direction against the print process cartridge when said third assembly is in the mating engagement with said print process cartridge;

wherein said guide mechanism includes:

said member of the holder that defines the hole, a projection that projects from a longitudinal end of said third assembly and extends through the hole, and a guide groove that is formed in a side wall of said print process cartridge; and wherein said guide groove slidably receives said projection therein.

9. An image-forming apparatus, comprising:

a first assembly that accommodates a print process cartridge that has a first engagement portion, said first assembly includes an opening that opens upwards of said image-forming apparatus;

a second assembly that is rotatably supported on said first assembly so that said second assembly is rotatable about an axis to open and close the opening;

a third assembly that is mounted to an inner side of said second assembly and extends in a first direction, said third assembly including a second engagement portion that engages said first engagement portion; and a guide mechanism that guides said third assembly into a mating engagement with said print process cartridge when said second assembly rotates to close the opening, wherein said guide mechanism guides said third assembly so that said second assembly engages said first assembly;

wherein said second assembly includes:

a holder that loosely holds said third assembly, and an urging member that urges said third assembly in a second direction against the print process cartridge when said third assembly is in the mating engagement with said print process cartridge;

wherein said print process cartridge has a surface that extends in the second direction;

wherein said third assembly includes a support that is attached to an end of said third assembly, said support having a first projection that is parallel to the axis to extend loosely into the hole and a second projection; and wherein further when said second assembly is rotated about the axis to close the opening, said second projection engages with said surface and then slides on said surface in the second direction until said third assembly is in the mating engagement with said print process cartridge.

10. The image-forming apparatus according to claim 9, wherein the axis is substantially at a midway point of a distance over which said second projection slides on said surface until said third assembly is in the mating engagement with said print process cartridge.

11. An image-forming apparatus, comprising:

a first assembly accommodating a print process cartridge that includes a photoconductive drum, said first assembly having a guide groove formed therein and an opening at a top portion thereof;

a second assembly rotatably supported on said first assembly so that said second assembly is rotatable about an axis to open and close the opening, said second assembly having an urging member mounted thereon;

a third assembly mounted to an inner side of said second assembly and longitudinally extending in a first direction, said third assembly having a projection that projects in the first direction from a longitudinal end of said third assembly, said third assembly including an exposing unit that illuminates the photoconductive drum to form an electrostatic latent image on the photoconductive drum; and a holder mounted on said second assembly and having a first member that defines a hole through which the projection extends such that said third assembly is loosely held by said holder;

wherein when said second assembly is rotated to close the opening, the projection is received and guided in the guide groove so that said third assembly moves into a mating engagement with the print process cartridge and is urged by the urging member in a second direction against the print process cartridge.

12. An image-forming apparatus, comprising:

a first assembly having an opening that opens upward of the image-forming apparatus and accommodating a print process cartridge that includes a photoconductive drum and a side wall, the side wall having a guide groove formed therein;

a second assembly rotatably supported on said first assembly so that said second assembly is rotatable about an axis to open and close the opening, said second assembly having an urging member mounted thereon;

a third assembly mounted to an inner side of said second assembly and longitudinally extending in a first direction, said third assembly having a projection that projects in the first direction from a longitudinal end of said third assembly, said third assembly including an exposing unit that illuminates the photoconductive drum to form an electrostatic latent image on the photoconductive drum; and a holder mounted on said second assembly and having a first member that defines a hole through which the projection extends such that said third assembly is loosely held by said holder;

wherein when said second assembly is rotated to close the opening, the projection is received and slides in the guide groove so that said third assembly moves into mating engagement with the print process cartridge and is urged by the urging member in a second direction against the print process cartridge.

13. An image-forming apparatus, comprising:

a first assembly having an opening that opens upward of the image forming apparatus, and accommodating a print process cartridge that includes a photoconductive drum and has a surface that extends in a first direction;

a second assembly rotatably supported on said first assembly so that said second assembly is rotatable about an axis to open and close the opening, said second assembly having an urging member mounted thereon;

a third assembly mounted to an inner side of said second assembly and longitudinally extending in a second direction, said third assembly having a first projection that projects in the second direction from a longitudinal end of said third assembly, and a second projection that extends substantially in a third direction perpendicular to the second direction, said third assembly including an exposing unit that illuminates the photoconductive drum to form an electrostatic latent image on the photoconductive drum;

a holder mounted on said second assembly and having a member that defines a hole through which the projection extends such that said third assembly is loosely held by said holder;

wherein as said second assembly is rotated about the axis to close the opening, the second projection moves into contact engagement with the surface and then slides on the surface in the first direction until said third assembly has moved into mating engagement with the print process cartridge and is finally urged by the urging member in the first direction against the print process cartridge.

14. An image-forming apparatus, comprising:

a housing that accommodates a print process cartridge that has a first engagement portion, said housing includes an opening that opens upwards of said image-forming apparatus;

a lid that is rotatably supported on said housing so that said lid is rotatable about an axis to open and close the opening;

a printhead assembly that is mounted to an inner side of said lid and extends in a first direction, said printhead assembly including a second engagement portion that engages said first engagement portion; and guide grooves that guide said printhead assembly into a mating engagement with said print process cartridge when said lid rotates to close the opening, wherein said guide grooves guide said printhead assembly so that said lid engages said housing.

* * * * *